United States Patent [19]

Shimada et al.

[11] Patent Number: 4,748,099

[45] Date of Patent: May 31, 1988

[54] PROCESS FOR FORMING PRINTING PLATE USING AN ELECTROPHOTOGRAPHIC MATERIAL FOR OBTAINING TONER IMAGE

[75] Inventors: Fumio Shimada; Masafumi Uehara; Masatoshi Matsuzaki, all of Hino, Japan

[73] Assignee: Konishiroku Photo Industry Co., Ltd., Tokyo, Japan

[21] Appl. No.: 68,737

[22] Filed: Jun. 30, 1987

Related U.S. Application Data

[63] Continuation of Ser. No. 907,630, Sep. 15, 1986, abandoned, which is a continuation of Ser. No. 530,972, Sep. 9, 1983, abandoned, which is a continuation of Ser. No. 424,215, Sep. 27, 1982, abandoned, which is a continuation of Ser. No. 230,503, Feb. 2, 1981, abandoned, which is a continuation of Ser. No. 8,407, Feb. 1, 1979, abandoned.

[30] Foreign Application Priority Data

Feb. 7, 1978 [JP] Japan ..... 53-12686
Apr. 11, 1978 [JP] Japan ..... 53-42381

[51] Int. Cl.[4] ..... G03G 13/32

[52] U.S. Cl. ..... 430/49; 430/96

[58] Field of Search ..... 430/49, 96; 101/465, 101/466

[56] References Cited

U.S. PATENT DOCUMENTS

| | | | |
|---|---|---|---|
| 3,207,601 | 9/1965 | Giaimo | 430/96 X |
| 3,401,037 | 9/1968 | Roteman et al. | 430/96 X |
| 3,765,884 | 10/1973 | Shea | 430/96 X |
| 3,816,118 | 6/1974 | Byrne | 430/96 X |
| 4,063,948 | 12/1977 | Lind | 430/49 |
| 4,218,528 | 8/1980 | Shimada et al. | 430/96 X |

*Primary Examiner*—Roland E. Martin
*Attorney, Agent, or Firm*—Frishauf, Holtz, Goodman & Woodward

[57] ABSTRACT

A process for forming a printing plate use a specific electrophotographic material for obtaining a toner image which comprises a support and a layer for obtaining an electrostatic latent image coated thereon, said layer being composed mainly of a phenol resin containing a phthalocyanine pigment and having a specific repeating unit.

15 Claims, 4 Drawing Sheets

PROCESS FOR FORMING PRINTING PLATE USING AN ELECTROPHOTOGRAPHIC MATERIAL FOR OBTAINING TONER IMAGE

This application is a continuation of Ser. No. 907,630, filed Sept. 15, 1986, now abandoned which is a continuation of Ser. No. 530,972 filed Sept. 9, 1983, now abandoned, which is a continuation of Ser. No. 424,215, filed Sept. 27, 1982 now abandoned which is a continuation of Ser. No. 230,503 filed Feb. 2, 1981 now abandoned, which is a continuation of Ser. No. 008,407 filed Feb. 1, 1979 now abandoned.

This invention relates to a novel electrophotographic material for obtaining a toner image and to a process for forming a printing plate using the original plate for printing.

More particularly, this invention relates to an electrophotographic material for obtaining a toner image which comprises a support and a layer for obtaining an electrostatic latent image coated thereon composed mainly of a specific phenol resin, and to a process for forming a printing plate by etching the layer forming thereon a toner image directly after processing by liquid development method or indirectly through transfer process.

As an original plate for printing, there have hitherto been known a silver halide light-sensitive material, a photosensitive resin, a photoreceptor obtained by dispersing in a resin such an inorganic photoconductive substance as zinc oxide, a photoreceptor obtained by mixing an organic photoconductive substance with a resin, and so on.

However, a printing plate which is made based on the diffusion transfer development of a silver halide light-sensitive material, is expensive with respect to one printing plate and shows little durability.

An original plate for printing in which is used a photosensitive resin shows remarkably lower sensitivity as compared with a photoconductive photoreceptor for electrophotography or a silver halide light-sensitive material, and requires accordingly a strong light source and an exposure for a long period of time, and thus the so-called direct plate-making can only be conducted.

Furthermore, there is found a method in which an electrophotographic light-sensitive plate, to which the sensitivity is allotted, is combined with a light-sensitive original plate for printing, to which the durability and the printing aptitude is allotted. In this method where, after transfer of a toner image, a photosensitive resin layer is cross-linked by over-all exposure and then the toner image portion is removed, there are some drawbacks in that a step for over-all exposure is required; a strong light source is necessary; it takes long time for the steps to make a printing plate; and so on.

As an original plate for printing for which is utilized electrophotography, there has been known an original plate for off-set printing in which is employed a zinc oxide-resin dispersion system, as described in, for example, British Pat. No. 1,259,555. The original plate for off-set printing is used by forming thereon a toner image by an electrophotographic process and then wetting it with an non-hydrophobic solution (e.g., an acidic solution containing a ferrocyanide or a ferricyanide) in order to make non-hydrophobical the non-image part thereof against an oil. The off-set printing plate thus treated and formed has a durability of around 5,000 to 10,000 sheets and does not suit for a printing in which higher durability is required. Further, when the printing plate is given a composition suitable for non-hydrophobics, the electrostatic property is lowered and the quality of a printed image pattern is worsened accordingly.

As an organic photoconductive material-resin type original plate for printing as described in Japanese Patent Publications Nos. 17,162/1962, 7758/1963 and 39405/1971, and so on, there is used a photoreceptor in which a photoconductive insulating layer, where oxazole or oxadiazole is bound by a styrene-maleic anhydride copolymer, is coated on a graved aluminium plate. A printing plate is formed by dissolving and removing the non-image part by use of an alkaline organic solvent after formation of a toner image on the photoreceptor by electrophotography. As the treating solvent for dissolving and removing the non-image part of the photoconductive insulating layer to make a printing plate, there is required an organic solvent such as ethylene glycol, glycerol, methanol or ethanol, which however is not preferable on the standpoint of cost, safety, public pollution, industrial hygiene and so on. Further, it requires a sensitizer such as a polymethine dye, and, even under use of a sensitizer, the original plate does not show a practically employable sensitivity in the range of a long wave-length of not less than 600 mμ., and a sufficient image recording can not be attained when an inexpensive He-Ne laser is used for the recording.

It further has drawbacks in that it is unsatisfactory in the resolving power and the adhesive property; it cannot reproduce fine image; it is bad in humidity reliability and its electrostatic property is liable to be changed by the change in humidity; it does not show good storability due to poor charge retention; and so on.

On the other hand, a liquid developer has generally been used as a developer for an electrostatic latent image on the grounds that a highly resolved image pattern can be obtained by fine grain development; a reversal development can be carried out; the developing apparatus is simple in its structure and operation; and so on.

A liquid developer is prepared by dispersing a toner composed of a colorant, a fixing agent, a charge controlling agent and so on, in a carrier liquid (hereinafter referred to as "carrier" for short). As the carrier may be used aliphatic hydrocarbons, alicyclic hydrocarbons, aromatic hydrocarbons, halogenated hydrocarbons, polymethylsiloxane and so on, which show an electric specific resistance of not less than $10^9$ Ωcm. However, phenomena such as deterioration of the developer and unclearness or streak of the image sometimes are observed depending upon the sort of the binders to be used in the recording layer. It has been known that such binder causes the deterioration of the developer and such phenomena constitute a remarkable obstacle to a clear and highly-resolved toner image.

An object of this invention is to provide an original plate for printing which is resistant against the liquid carrier for a liquid developer and with which a clear image can be obtained accordingly.

Another object of this invention is to provide an original plate for printing which is excellent in sensitivity, charge-acceptance, humidity resistance and electrostatic property.

A further object of this invention is to provide an original plate for printing with which a printing plate for either positive-positive or negative-positive use can be developed by one kind of developers and which can be charged either positively or negatively.

A still further object of this invention is to provide an original plate for printing which has a recording layer which is easily soluble in an alkaline aqueous solution.

It is a still further object of this invention to provide on electrophotographic photoreceptor, which shows relatively high sensitivity and is excellent in gradation and repetition property.

These objects of this invention can be attained by using the electrophotographic material of this invention which will be explained hereinafter in detail.

The elctrophotographic material of this invention comprises a support and a layer for obtaining an electrostatic latent image thereon, which layer comprises as a main component a phenol resin having a repeating unit represented by the formula:

[1]

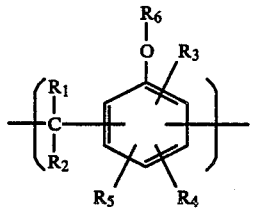

wherein $R_1$ and $R_2$ each represent hydrogen, a lower-alkyl group, an aryl group or a furfuryl group, provided that one of $R_1$ and $R_2$ is an aryl group or a furfuryl group when the other is hydrogen; $R_3$, $R_4$ and $R_5$ each represent hydrogen, halogen, a hydroxyl group, a nitro group, an amino group, a cyano group, a carboxyl group or a salt thereof, a sulfo acid group or a salt thereof, a chain hydrocarbon group having 1 to 20 carbon atoms or a cyclic hydrocarbon group having 4 to 14 carbon atoms, provided that, when at least one of said $R_3$, $R_4$ and $R_5$ has not less than 4 carbon atoms, at least one of $R_3$, $R_4$ and $R_5$ is a hydrophilic group or at least one of $R_3$, $R_4$ and $R_5$ is a group having a hydrophilic substituent; and $R_6$ represents hydrogen or a glycidyl group.

Further, when at least one of said $R_1$ and $R_2$ has not less than 4 carbon atoms, at least one of $R_3$, $R_4$ and $R_5$ is preferably a hydrophilic group or at least one of $R_3$, $R_4$ and $R_5$ is a group having hydrophilic substituent, and $R_6$ is hydrogen preferably.

A preferable hydrophilic group and hydrophilic substituent represent a hydroxy group, an amino group, a sulfo group or a salt thereof and a carboxy group or a salt thereof.

The lower-alkyl group (preferably of 1–3 carbon atoms) represented by $R_1$ or $R_2$ in the above formula includes a methyl group, an ethyl group, an n-propyl group and an i-propyl group, and preferably a methyl group. The chain hydrocarbon group represented by $R_3$, $R_4$ or $R_5$ in the above formula includes an alkyl group such as a methyl group, an ethyl group, a propyl group, a butyl group, an octyl group and a pentadecyl group; an alkoxy group such as a methoxy group and an ethoxy group; an alkoxyalkyl group such as a methoxymethyl group, a $\beta$-methoxyethyl group and an ethoxymethyl group; an alkylcarbonylalkyl group such as an acetylmethyl group and a propanoylmethyl group and an acyl group such as an acetyl group and a propanoyl group; all of these groups having 1 to 20 carbon atoms. An alkyl group in the chain hydrocarbon group is most preferable.

The cyclic hydrocarbon group represented by $R_3$, $R_4$ or $R_5$ in the above formula includes a phenyl group, a naphthyl group, an anthranyl group (anthracene ring), a cyclobutyl group, a cyclopentyl group, a cyclohexyl group, a cycloheptyl group and a cyclooctyl group. A phenyl group in the cyclic hydrocarbon group is the most preferable.

While the electrophotographic material according to this invention may also be employed for the purpose of providing an electrophotographic photoreceptor per se, besides an original plate for printing, in cases where the material is directed for an electrophotographic photoreceptor per se, there may preferably be used a phenol resin having a repeating unit represented by the formula:

[2]

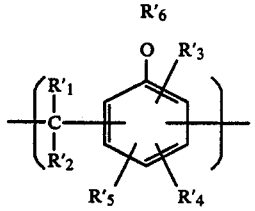

wherein $R'_1$ and $R'_2$ may be the same or different and each represent hydrogen or a methyl group; $R_3$, $R_4$ and $R_5$ may be the same or different and each represent hydrogen, halogen; a hydroxyl group, a nitro group, a cyano group, an amino group, a carboxyl group or a salt thereof; a sulfo group or a salt thereof, and a substituted or unsubstituted, saturated or unsaturated hydrocarbon chain having 1 to 3 carbon atoms such as an alkyl group, an alkoxy group, an allyl group, an alkoxyalkyl group, an alkylcarbonylalkyl group, an acyl group, etc., and a photoconductive phthalocyanine pigment dispersed in the resin.

Preferable substituent of the hydrocarbon group is halogen, a carboxyl group or a salt thereof, a sulfo group or a salt thereof, a cyano group, or a hydroxyl group.

The present invention also includes a process for forming a printing plate which comprises forming a toner image by liquid development on a recording layer composed mainly of a phenol resin having the above-mentioned repeating unit and coated on a support and then dissolving the area of the recording layer which carries no toner image with an alkaline solution to remove the same.

Namely, according to this invention featured by the constitution as mentioned above, the effect as mentioned below can be made. For instance, a liquid developer is employed to convert an electrostatic latent image formed on an original plate for printing into a visible image. Thus, a toner image having high resolving power can be obtained, and a printing plate having high resolving power and being excellent in durability resistance can also be obtained, in which there is no streak of an image; the recording layer does not soften and deformed; and the developer does not deteriorate since a phenol resin having a specific structure resistant to a liquid developer is employed as a main component.

The layer for obtaining an electrostatic latent image according to this invention may comprise a layer which contains only a resin or may be a layer which additionally contains a photoconductive material. In case of the latter, it may be charged positively or negatively depending upon the property of the specific phenol resin employed, and a printing plate for either positive-positive or negative-positive use can be formed with one kind of developers by utilization a reversal process.

Further, since the resin according to this invention is soluble in an alkaline solution, the portion of the resin, the surface of which carries no toner image, can readily be dissolved and removed without any heat-treatment so that a clear-cut etching can be effected.

The method according to this invention includes also a plate-making process which comprises forming preliminarily an electrostatic latent image on an electrophotographic material; transferring electrostatically the image to the original plate for printing according to this invention; converting then the electrostatic latent image thus transferred into a toner image by liquid development; and then etching the original plate with an alkaline solution to make a printing plate. Since the specific phenol resin of this invention is excellent in charge-acceptance property, an electrostatic latent image transferred can easily be formed.

The original plate for printing according to this invention may also be used advantageously in cases where a toner image preliminarily is formed on a recording material and then transferred to the recording material according to this invention to make a printing plate.

The phenol resin, which is used as a main component of the binder resin for the original plate for printing, may include a modified phenol resin having the repeating unit represented by the general formula mentioned above or a modified co-condensate-polymer of a monomer giving the repeating unit of the general formula with a phenol resin monomer other than that, the modification being carried out with an epoxy, polyvinyl alcohol, etc.

The average molecular weight of the phenol resin used in this invention ranges from 240 to 20,000, preferably from 350 to 6,000, and may desirably be soluble in a solvent, e.g., ketones such as acetone, methyl ethyl ketone, methyl isobutyl ketone and cyclohexanone; glycol ethers such as ethylene glycol monomethyl ether, ethylene glycol monoethyl ether, 2-methoxyethyl acetate and dioxane; esters such as butyl acetate and ethyl acetate; and the like.

As the phenol resin which may effectively be employed in this invention, there may be exemplified the following. In the formulae, 1, m and n each represent the molar ratio of monomers polymerized and M represents the average molecular weight.

Examplified Resin (1)

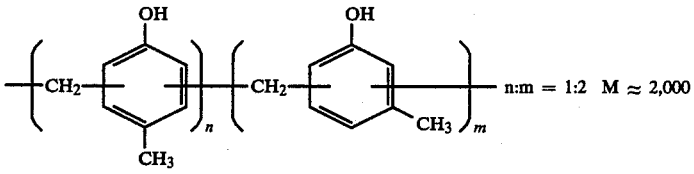

n:m = 1:2 M ≈ 2,000

(2)

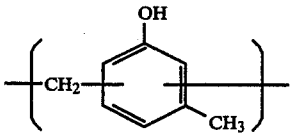

M ≈ 1,600

(3)

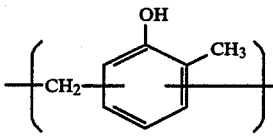

M ≈ 6,000

(4)

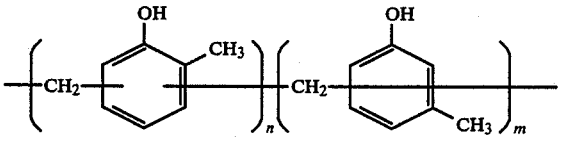

n:m = 1:3 M ≈ 1,000

(5)

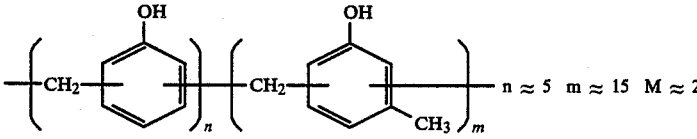

n ≈ 5 m ≈ 15 M ≈ 2,000

(6)

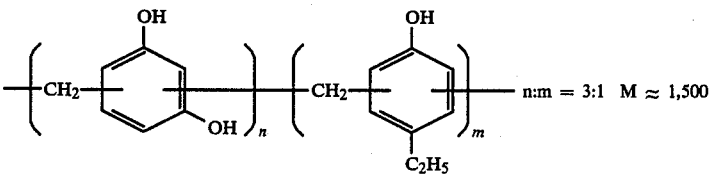

n:m = 3:1 M ≈ 1,500

(7)

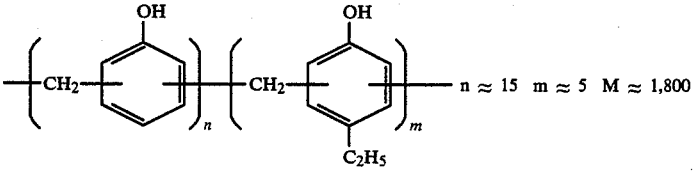

n ≈ 15 m ≈ 5 M ≈ 1,800

-continued
Examplified Resin
(8)
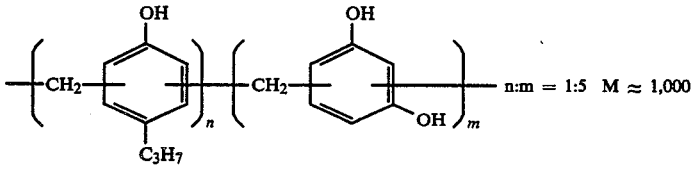
n:m = 1:5 M ≈ 1,000
(9)
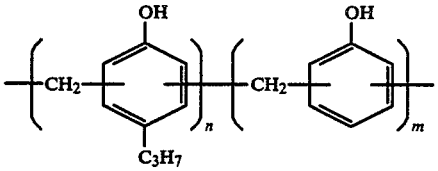
n ≈ 5 m ≈ 25 M ≈ 1,500
(10)
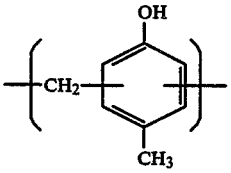
M ≈ 2,000
(11)
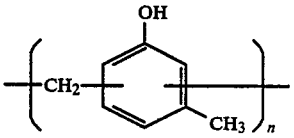
n ≈ 3 M ≈ 360
(12)
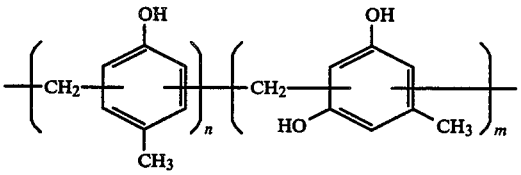
n:m = 1:2 M ≈ 2,000
(13)
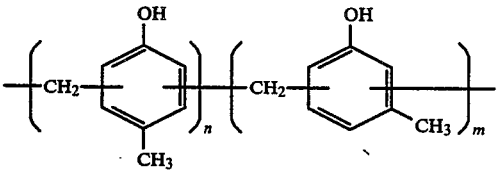
n ≈ 30 m ≈ 60 M ≈ 1,500
(14)
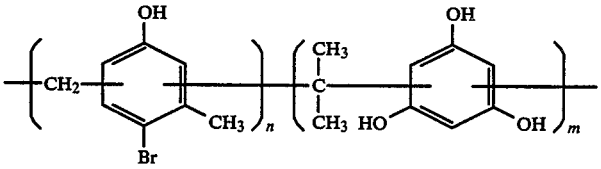
n:m = 4:1 M ≈ 2,100
(15)
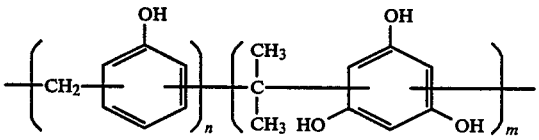
n ≈ 20 m ≈ 3 M ≈ 2,000
(16)
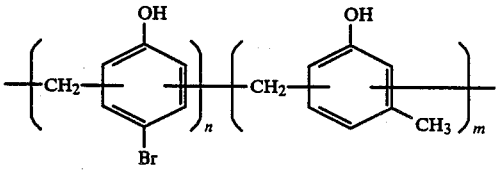
n:m = 1:3 M ≈ 1,500
(17)
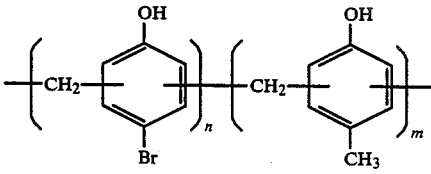
n ≈ 5 m ≈ 15 M ≈ 1,200

-continued
Examplified Resin
(18)
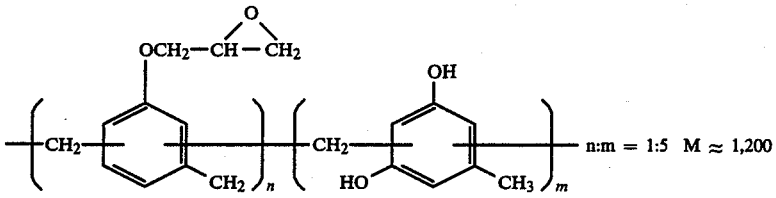
n:m = 1:5 M ≈ 1,200
(19)
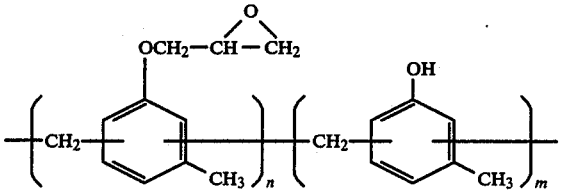
n ≈ 5 m ≈ 15 M ≈ 1,500
(20)
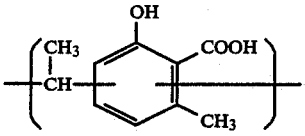
M ≈ 1,800
(21)
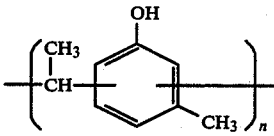
n ≈ 15 M ≈ 2,000
(22)
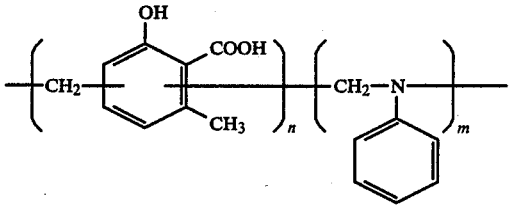
n:m = 10:1 M ≈ 1,000
(23)
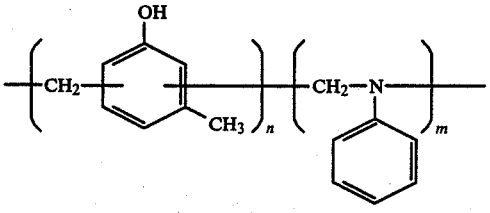
n:m = 1:9 M ≈ 3,000
(24)
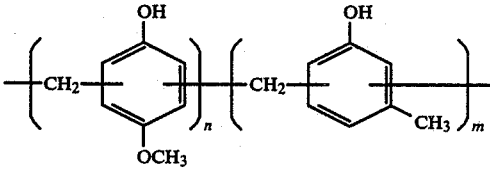
n:m = 1:4 M ≈ 1,200
(25)
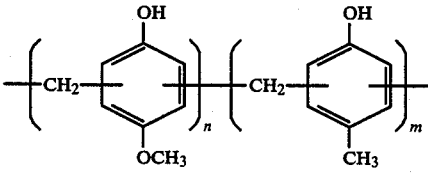
n:m = 1:4 M ≈ 1,500
(26)
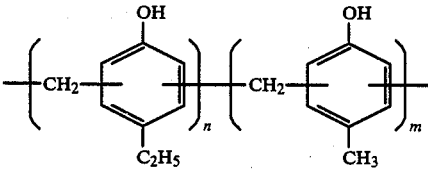
n:m = 2:3 M ≈ 1,200

-continued
Examplified Resin
(27)
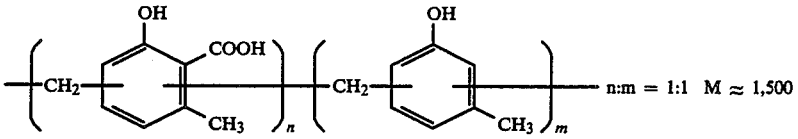
n:m = 1:1 M ≈ 1,500
(28)
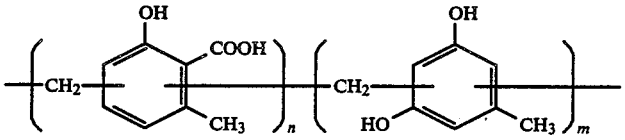
n:m = 1:3 M ≈ 2,500
(29)
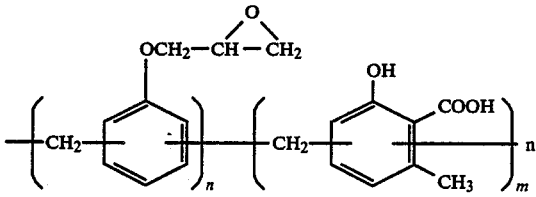
n:m = 1:3 M ≈ 1,000
(30)
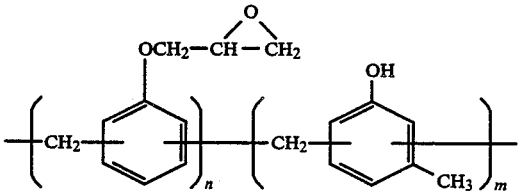
n:m = 1:5 M ≈ 1,200
(31)
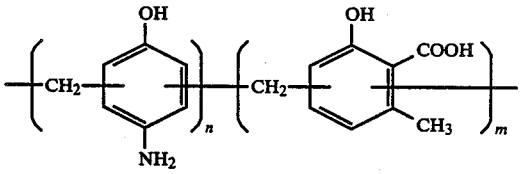
n:m = 1:3 M ≈ 1,600
(32)
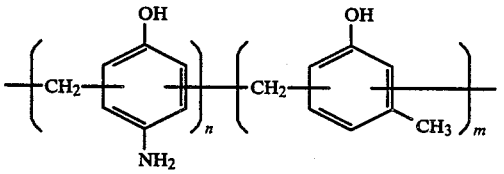
n:m = 1:3 M ≈ 1,800
(33)
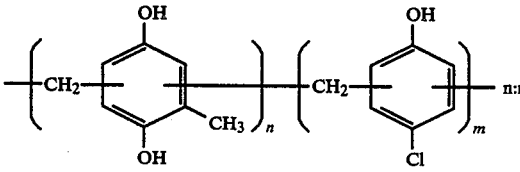
n:m = 1:1 M ≈ 1,500
(34)
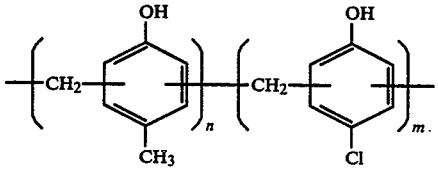
n:m = 5:1 M ≈ 1,200
(35)
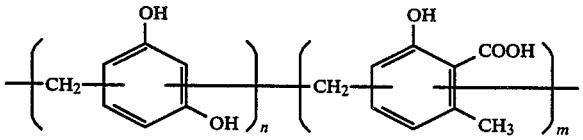
n:m = 1:3 M ≈ 2,000

-continued
Examplified Resin
(36)
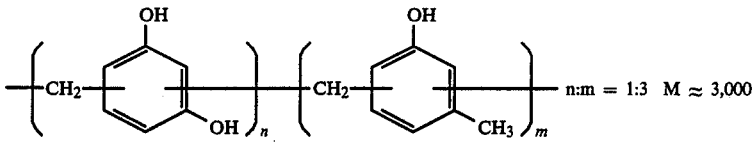
n:m = 1:3 M ≈ 3,000
(37)
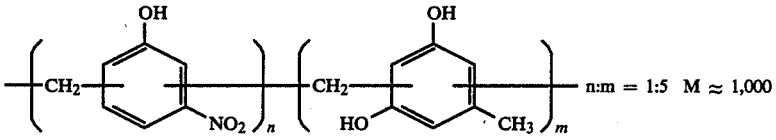
n:m = 1:5 M ≈ 1,000
(38)
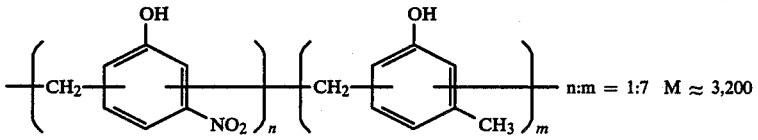
n:m = 1:7 M ≈ 3,200
(39)
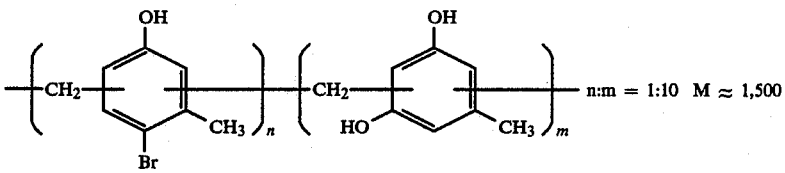
n:m = 1:10 M ≈ 1,500
(40)
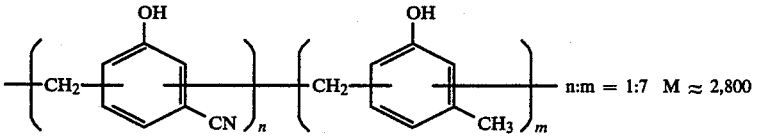
n:m = 1:7 M ≈ 2,800
(41)
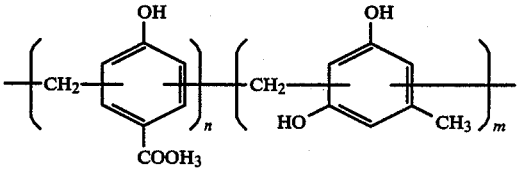
n:m = 1:3 M ≈ 2,000
(42)
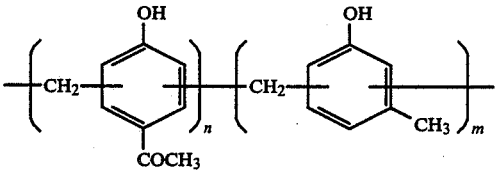
n:m = 1:3 M ≈ 1,600
(43)
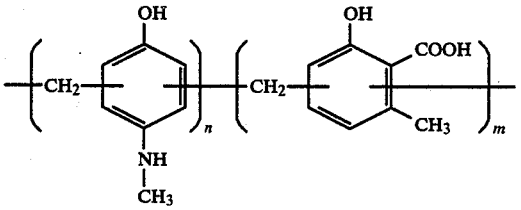
n:m = 1:5 M ≈ 1,500
(44)
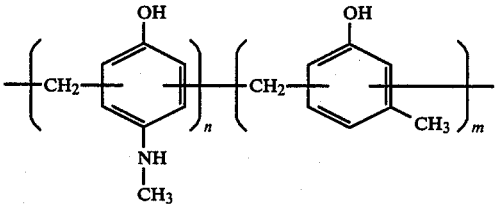
n:m = 1:7 M ≈ 2,800

-continued
Examplified Resin
(45)
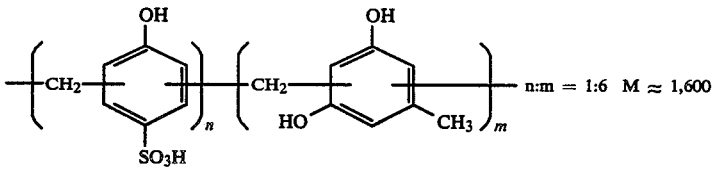
(46)
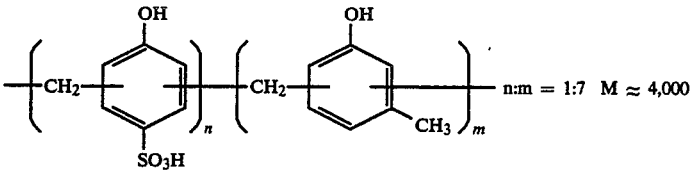
(47)
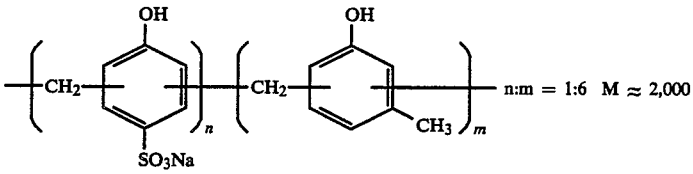
(48)
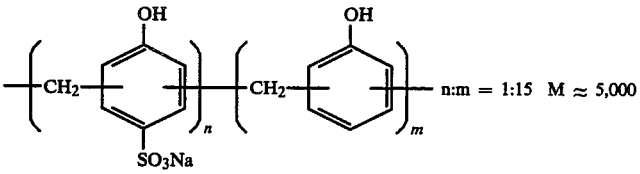
(49)
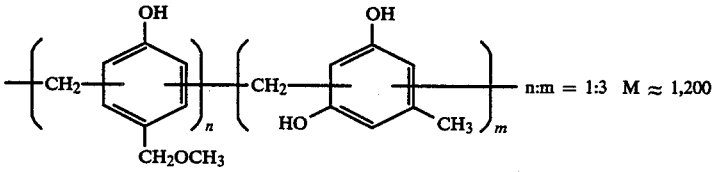
(50)
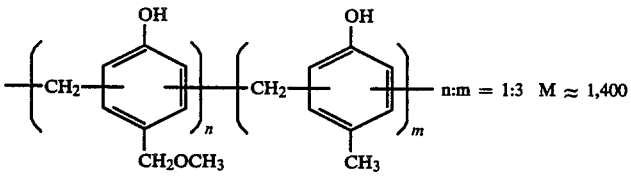
(51)
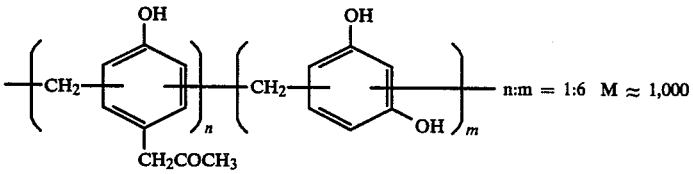
(52)
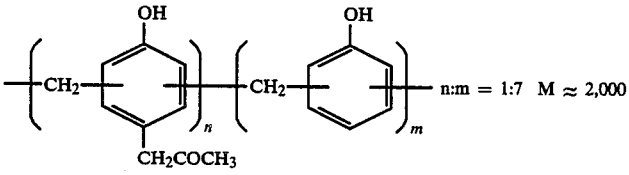

-continued
Examplified Resin
(53)
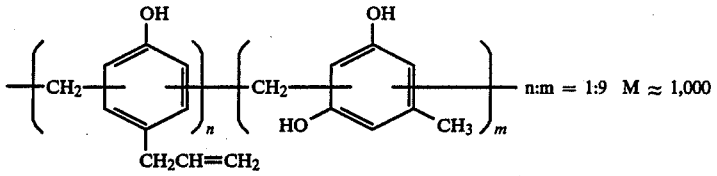
(54)
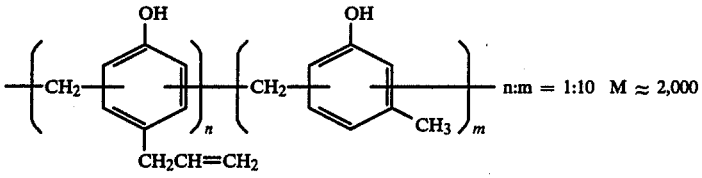
(55)
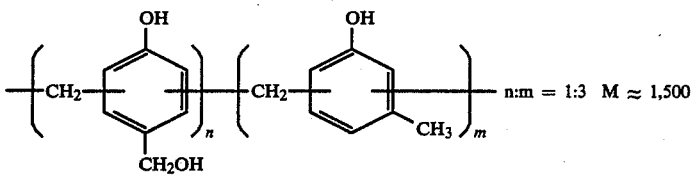
(56)
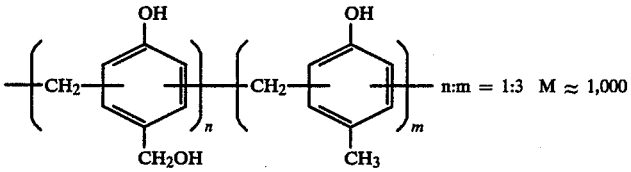
(57)
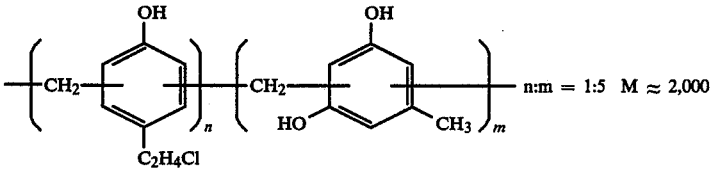
(58)
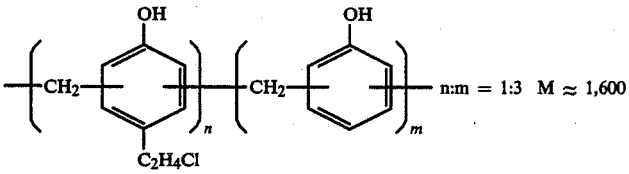
(59)
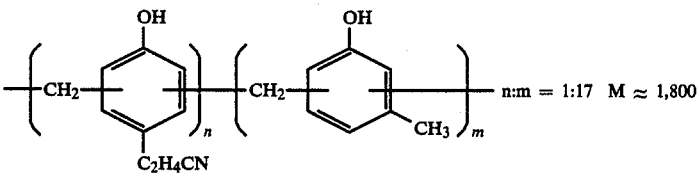
(60)
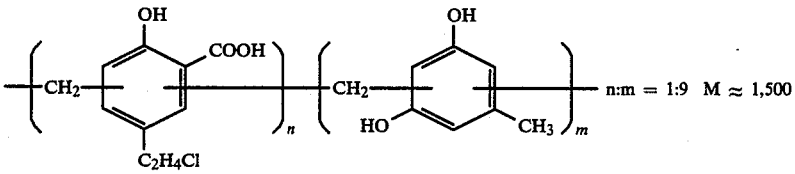

-continued
Examplified Resin
(61)
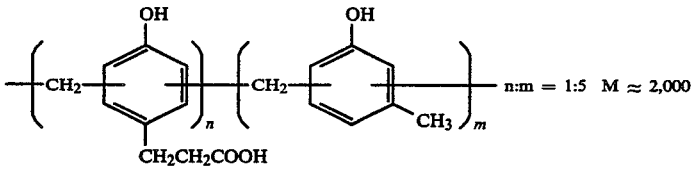
(62)
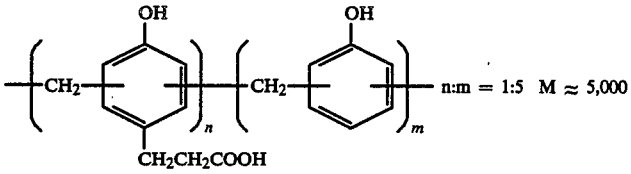
(63)
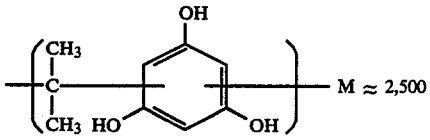
(64)
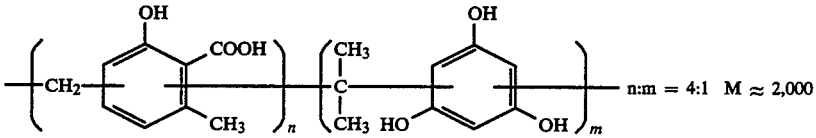
(65)
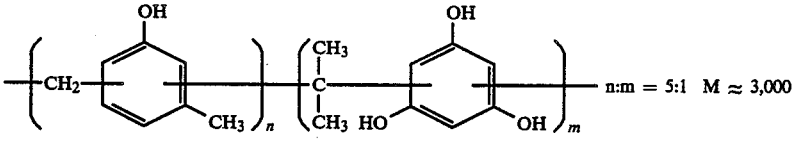
(66)
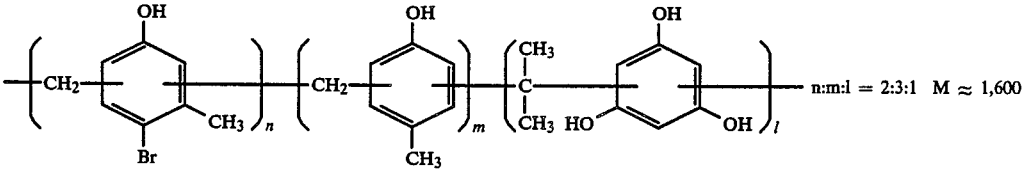
(67)
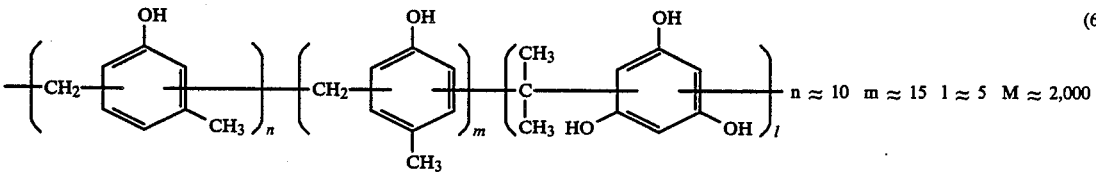
(68)
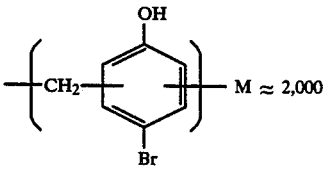
(69)
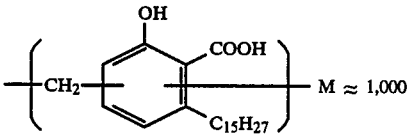
(70)
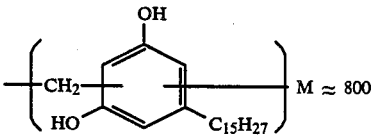

-continued
Examplified Resin
(71)
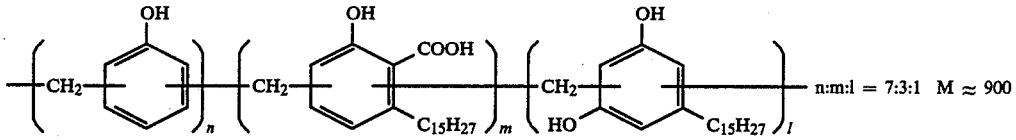
(72)
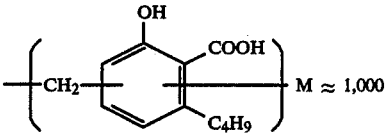
(73)
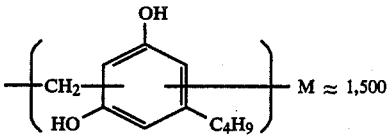
(74)
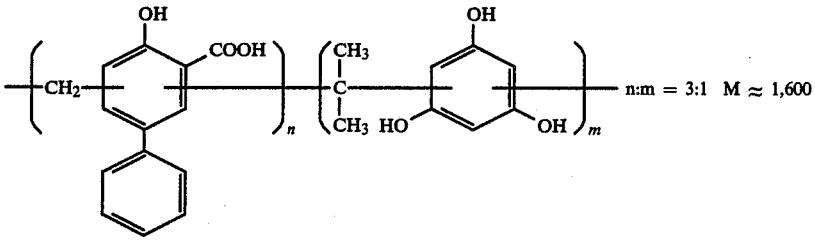
(75)
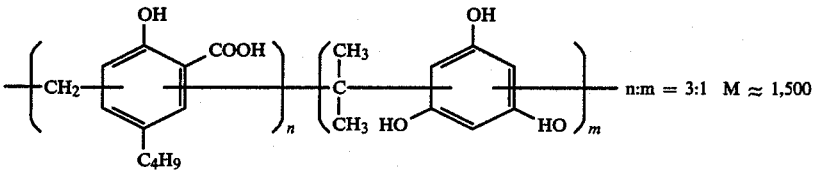
(76)
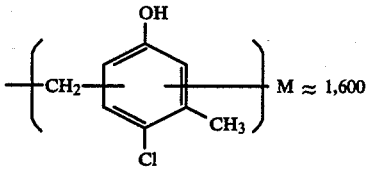
(77)
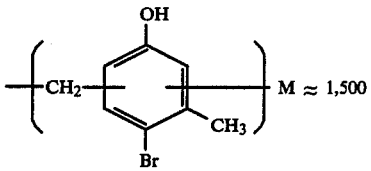
(78)
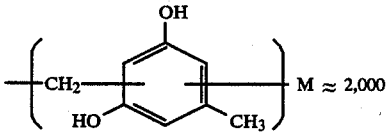
(79)
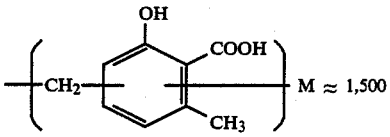
(80)
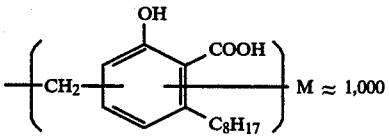
(81)
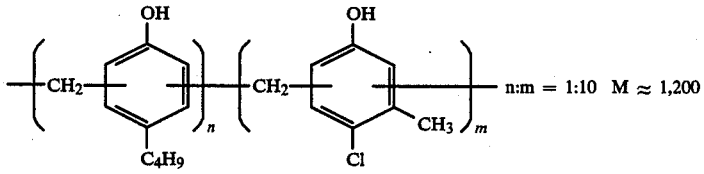
(82)
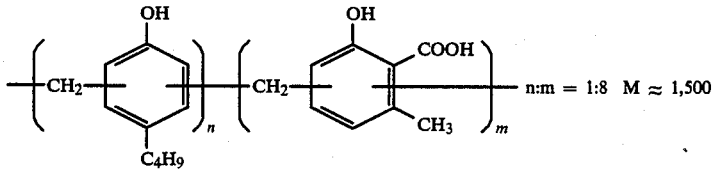

-continued
Examplified Resin
(83)
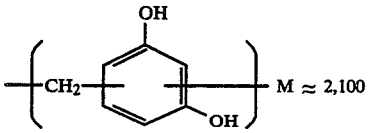
M ≈ 2,100
(84)
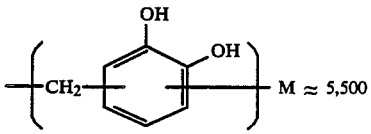
M ≈ 5,500
(85)
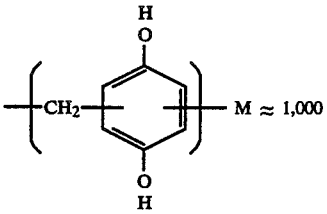
M ≈ 1,000
(86)
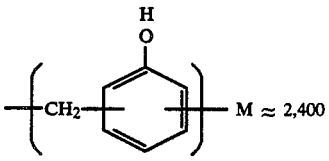
M ≈ 2,400
(87)
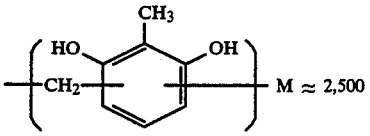
M ≈ 2,500
(88)
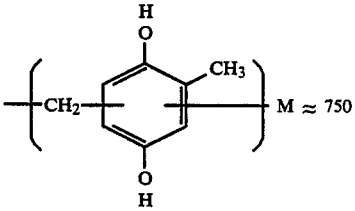
M ≈ 750
(89)
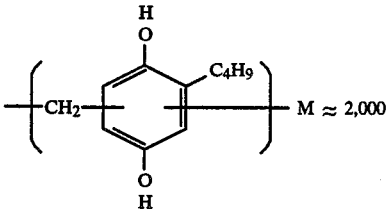
M ≈ 2,000
(90)
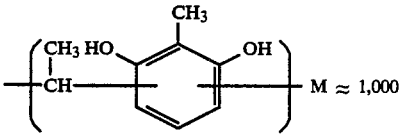
M ≈ 1,000
(91)
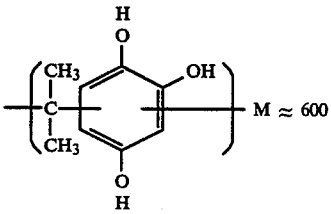
M ≈ 600
(92)
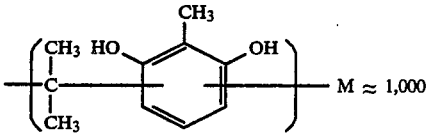
M ≈ 1,000
(93)
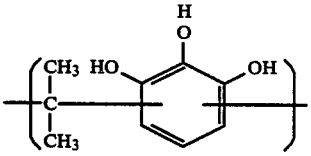
M ≈ 1,600
(94)
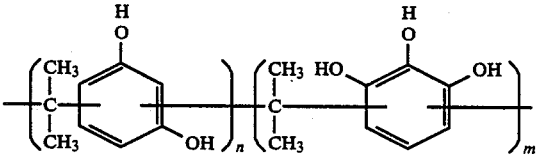
n:m = 1:1 M ≈ 1,800
(95)
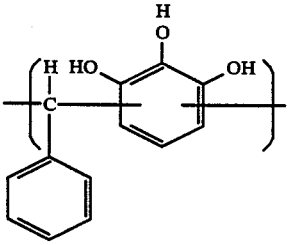
M ≈ 1,000
(96)
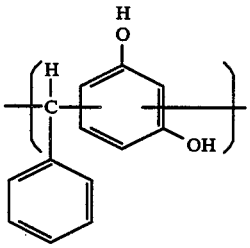
M ≈ 1,200

Examplified Resin

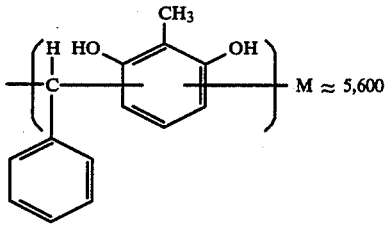

(97)

-continued

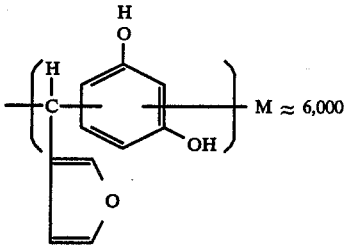

(98)

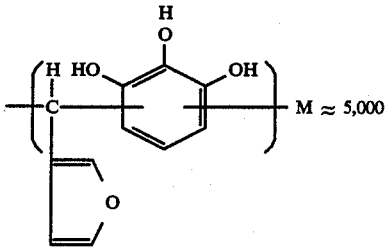

(99)

The present phenol resin may be prepared according to U.S. Pat. No. 3,635,709 and Journal of Applied Chemistry Vol. 7, P676 (1957).

As the photoconductive material which may be incorporated in the recording layer of the electrophotographic material according to this invention, there may be employed an inorganic or organic photoconductor, or a photoconductive organic pigment.

As the inorganic photoconductor, there may be mentioned, for example, zinc oxide, cadmium sulfide, titanium oxide, selenium, cadmium selenide, zinc selenide and zinc oxide. As the organic photoconductor may be mentioned a substituted vinyloxazole, e.g., 2-vinyl-4-(2'-chlorophenyl)-5-(4''-diethylaminophenyl)oxazole; a triphenylamine derivative; a higher condensed aromatic compound, e.g, anthracene; a benzo-condensed heterocylic compound; a pyrazoline derivative, e.g., 1-phenyl-3-(p-diethylaminostyryl)-5-(p-diethylaminophenyl)-pyrazoline; an imidazoline derivative; a triazole derivative; an oxadiazole derivative, e.g., 2,5-bis(4'-diethylaminophenyl)-1,3,4-oxadiazole; a vinyl aromatic polymer, e.g., polyvinyl anthracene, polyacenaphthylene and poly-N-vinyl carbazole, and a copolymer of vinyl aromatic compounds for these polymers; 2,4,7-trinitro-9-fluorenone, 2,4,5,7-tetranitrofluorenone; a polyarylalkane, e.g., a triarylmethane Leuco pigment; a dye of a squaric acid derivative; 2,4,8-trinitrothioxantone; and so on.

The phthalocyanine pigment included in the photoconductive organic pigment employed in this invention is a photoconductive phthalocyanine group pigment described in U.S. Pat. No. 3,672,979 and No. 3,816,118 and is represented by the general formula:

$$(C_8H_4N_2)_4R_k$$

wherein R represents hydrogen, deuterium, sodium, potassium, copper, silver, beryllium, magnesium, calcium, zinc, cadmium, barium, mercury, aluminium, gallium, indium, lanthanum, neodynium, samarium, europium, gadolinium, dysprosium, holmium, erbium, thulium, ytterbium, lutetium, titanium, tin, hafnium, lead, thorium, vanadium, antimony, chromium, molybdenum, uranium, manganese, iron, cobalt, nickel, rhodium, palladium, osmium or platinum, and k is 0 to 2.

Among these, there are preferred in particular an $\alpha$, $\beta$, $\gamma$, $\pi$, X or $\epsilon$ type of a non-metal phthalocyanine, or a metal phthalocyanine such as copper, cobalt, lead and zinc phthalocyanines.

As the azo pigment, there are used in this invention a monoazo pigment of general formula (I) shown below and a disazo pigment of general formula (II) shown below, both of wich are photoconductive azo pigments.

General formula (I):

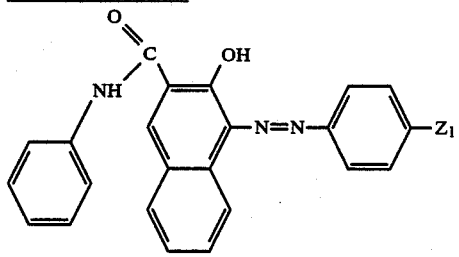

(I)

wherein $Z_1$ represents an atom or a group, e.g., $-NO_2$, $-CN$, $-Cl$, $-Br$, $-H$, $-CH_3$, $-OCH_3$, $-OC_2H_5$, $-N(C_2H_5)_2$, etc.

General formula (II):

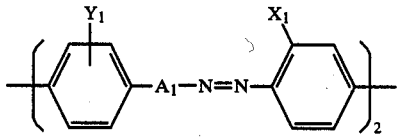

(II)

wherein $A_1$ represents a group

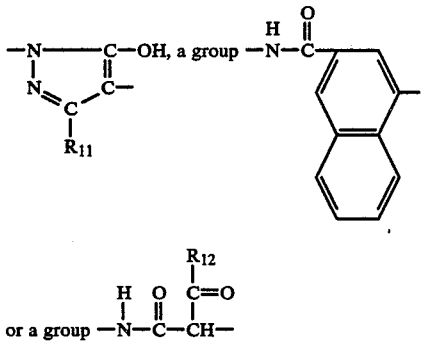

in which $R_{11}$ and $R_{12}$ each represent a loweralkyl group; and $X_1$ and $Y_1$ each represent an atom or a group of $—NO_2$, —CN, —H, $—CH_3$, $—OCH_3$, $—OC_2H_5$, —OH, —Cl, —Br, $—N(C_2H_5)_2$, etc.

Of the compounds represented by the general formulae mentioned above, there may be preferred in particular Dian Blue which is a kind of disazo pigments.

As the quinacridone pigment which may be employed in this invention, there may be mentioned a quinacridone pigment which is described in, for example, Japanese Provisional Patent Publication No. 49-30332/1974 and represented by the general formula mentioned below which may have a substituent as occasion demands.

General formula:

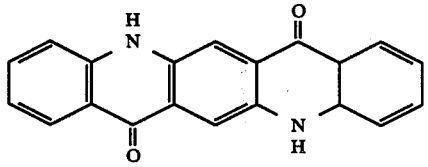

Of the pigments represented by the general formula mentioned above, there may be preferred in particular a β- and γ-type linear trans-quinacridones which may be unsubstituted or substituted with a methyl group or chlorine.

As the benzimidazole pigment which may be employed in this invention, there may be preferred a benzimidazole pigment which is described in, for example, Japanese Provisional Patent Publication No. 47-18543/1973 and which is a trans-form compound represented by general formula (III) mentioned below or a cis-form compound represented by general formula (IV) mentioned below.

General formula (III):

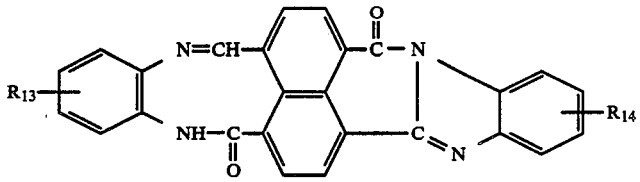

(III)

General formula (IV):

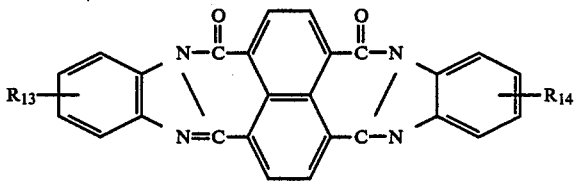

(IV)

In the above formulae, $R_{13}$ and $R_{14}$ each represent a group having 1–4 carbon atoms selected from the group consisting of an alkyl group which may be substituted, halogen, a nitro group and an amino group, and in cases where the number of the substituents is more than one, the substituents may be the same or different from each other. Further, the substituents $R_{13}$ and $R_{14}$ each may form a condensed ring with the benzene nucleus. Besides, a pigment having a heterocyclic group, which is formed by the reaction of naphthalene-1,4,5,8-tetracarboxylic acid with a heterocyclic diamine, may effectively be employed in this invention.

As the indigo pigment may be employed in this invention, there may be mentioned for example a trans-indigo pigment represented by general formula (V) mentioned below and a cis-indigo pigment represented by general formula (VI) mentioned below, which are described in Japanese Provisional Patent Publication No. 47-30331/1972.

General formula (V):

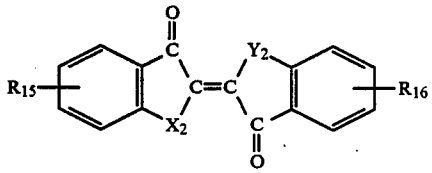

(V)

General formula (VI):

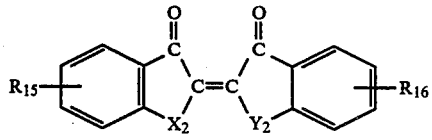

(VI)

In the above formulae, $R_{15}$ and $R_{16}$ may be the same or different and each represent an alkyl group, an aryl group, an amino group or halogen; $X_2$ and $Y_2$ each represent a group or an atom selected from the group consisting of —NH—, —O—, —S—, —Se— and —Te—; and the substituents may be the same each other.

Among these compounds, there is preferred in particular an unsubstituted trans-indigo in which $X_2$ and $Y_2$ each represents —NH— or sulfur.

As the quinone pigment which may be employed in this invention, there may be mentioned, for example, a multiple-ring guinone pigment described in Japanese Provisional Patent Publication No. 47-18544/1972, preferably anthanthrone, pyranthrone, dibenzpyrenequinone, pyrenequinone, 3,4,9,10-dibenzpyrenequinone, brominated anthanthrone, brominated dibenzpyrenequinone, brominated pyranthrone, anthraquinonethiazole, flavanthrone and the like.

As the perylene pigment which may be employed in this invention, there may be mentioned, for example, a pigment described in U.S. Pat. No. 3,871,882 and represented by general formula (VII) mentioned below or general formula (VIII) mentioned below.

General formula (VII):

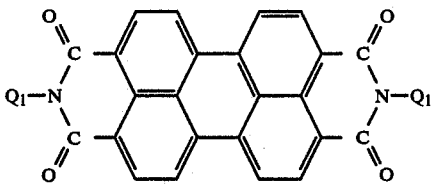

(VII)

wherein $Q_1$ represents an alkyl group, an aryl group, an alkylaryl group, an alkoxy group, a heterocyclic ring or halogen.

General formula (VIII):

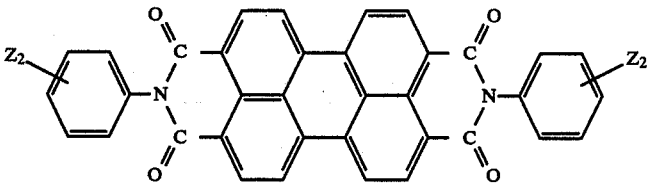

(VIII)

wherein $Z_2$ represents chlorine or a methoxy group.

As the quinoline pigment which may be employed in this invention, there may be mentioned, for example, a quinoline pigment described in Japanese Provisional Patent Publication No. 49-1231/1974 and represented by the general formula mentioned below.

$$[Q_2-CH=(CH-CH=)_nQ_2]^+X^-$$

wherein X represents iodine or bromine; $Q_2$ is a quinoline ring; and n is an integer of 0 to 3.

As the cyanine pigment which may be employed in this invention, there may be mentioned, for example, a pigment described in Japanese Provisional Patent Publication No. 47-37544/1972 and represented by the general formula mentioned below.

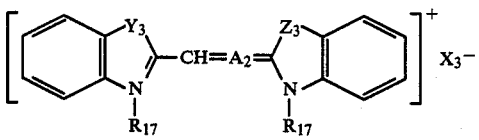

wherein $R_{17}$ represents a methyl group, an ethyl group or an allyl group; $X_3$ represents chlorine, bromine or iodine; $Y_3$ and $Z_3$ each represent oxygen, sulfur or selenium; and $A_2$ represents a group $=C(Q_3)-CH=$, a group $=CH-C(Q_3)=CH-CH=$ or a group $=CH-CH=C(Q_3)-CH=CH-CH=$, in which $Q_3$ is hydrogen, a methyl group or an ethyl group.

As the pyrylium salt pigment which may be employed in this invention, there may be mentioned, for example, a pigment described in Japanese Patent Publications Nos. 22519/1971, 22518/1971, etc., and represented by the general formula mentioned below.

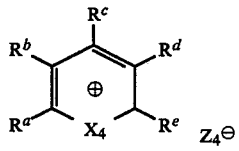

In the above formula, $R^a$, $R^b$, $R^c$, $R^d$ and $R^e$ each represent hydrogen, an aliphatic group or an aromatic group having 1 to 15 carbon atoms. These groups may be exemplified by an alkyl group such as methyl, ethyl, propyl, isopropyl, butyl, t-butyl, amyl, isoamyl, hexyl, octyl, nonyl, dodecyl, etc.; a styryl group such as styryl, methoxystyryl, diethoxystyryl, diethylaminostyryl, 1-butyl-4-p-dimethylaminophenyl-1,3-butadienyl, β-ethyl-4-dimethylaminostyryl, etc.; an alkoxy group such as methoxy, ethoxy, propoxy, butoxy, amyloxy, hexyloxy, octyloxy, etc.; a phenyl group, a 4-diphenyl group, an alkylphenyl group such as 4-ethylphenyl, 4-propylphenyl and the like, an alkoxyphenyl group such as 4-ethoxyphenyl, 4-methoxyphenyl, 4-amyloxyphenyl, 2-hexoxyphenyl, 2-methoxyphenyl, 3,4-dimethoxyphenyl and the like, a β-hydroxyalkoxyphenyl group such as 2-hydroxyethoxyphenyl, 3-hydroxyethoxyphenyl and the like, a 4-hydroxyphenyl group, a halophenyl group such as 2,4-dichlorophenyl, 3,4-dibromophenyl, 4-chlorophenyl, 2,4-dichlorophenyl and the like, an azidophenyl grouup, a nitrophenyl group, an aminophenyl group such as 4-diethylaminophenyl, 4-dimethylaminophenyl and the like; a naphthyl group; a vinyl group; and so on. $X_4$ represents sulfur, oxygen or selenium and $Z_4$ represents an anionic functional group including perchlorate, fluoroborate, iodate, chloride, bromide, sulfate, sulfonate, periodate, p-toluenesulfonate and the like. Further, a pair of $R^a$ and $R^b$ and a pair of $R^d$ and $R^e$ each represent a group of atoms necessary for forming cooperatively an aryl ring which is closed to form a pyrylium nucleus.

The electrophotographic material according to this invention may effectively be employed not only for a laminated original plate for electrophotographic printing but also an electrophotographic photoreceptor, in which a charge-generating layer is laminated on a charge-transporting layer.

For the original plate for electrophotographic printing according to this invention, there may be used a dye sensitizer or a chemical sensitizer. As the dye sensitizer may be used, for example, Malachite Green, Crystal Violet, Methyl Violet, Night Blue, Victoria Blue, Rhodamine B, Capri Blue, Methylene Blue, Fuchsine, Rose Bengale, Polymethine dyes, thioxanthene group pigments and so on.

The chemical sensitizer which may be employed in this invention includes quinones such as, for example, p-benzoquinone, 2,5-dichlorobenzoquinone, benzophenonetetracarboxylic acid dianhydride, 2,6-dichlorobenzoquinone, chloranil, naphthoquinone(1.4), 2,3-dichloronaphthoquinone-(1.4), anthraquinone, 2-methylanthraquinone, 1,4-dimethylanthraquinone, 1-chloroanthraquinone, anthraquinone-2-carboxylic acid, 1,5-dichloroanthraquinone, 1-chloro-4-nitroanthraquinone, phenanthrene-quinone, acenaphthenequinone, pyranthrenequinone, chrysen-quinone, thio-naphthenquinone, anthraquinone-1,8-disulfonic acid and anthraquinone-2-aldehyde; triphthaloylbenzene; aldehydes such as, for example, bromal, 4-nitrobenzaldehyde, 2,6-dichlorobenzaldehyde, 2-ethoxy-1-naphthoaldehyde, anthracene-9-aldehyde, pyrene-3-aldehyde, oxyindole-3-aldehyde, pyridine-2,6-dialdehyde and biphenyl-4-aldehyde; organic phosphonic acids such as, for example, 4-chloro-3-nitrobenzenephosphonic acid; nitrophenols such as, for example, 4-nitrophenol; picric acid; acid anhydrides such as, for example, acetic anhydride, succinic anhydride, maleic anhydride, phthalic anhydride, tetrachlorophthalic anhydride, pyrene-3,4,9,10-tetracarboxylic acid anhydride and chrysene-2,3,8,9-tetracarboxylic acid anhydride; halogenides of metals and metalloid belonging to Group IB, II and VIII of the Periodic Table, such as, for example, aluminium chloride, zinc chloride, ferric chloride, tin tetrachloride (stannic chloride), arsine trichloride, stannous chloride, antimony pentachloride, magnesium chloride, magnesium bromide, calcium bromide, calcium iodide, strontium bromide, chromium bromide, manganous chloride, cobaltous chloride, cobaltic chloride, cupric bromide, celium chloride, thorium chloride and arsine triiodide; boron halogenide compounds such as, for example, boron trifluoride and boron trichloride; ketones such as, for example, acetophenone, benzophenone, 2-acetylnaphthalene, benzil, benzoin, 5-benzoylacenaphthene, 9-acetylanthracene, 9-benzoylanthracene, 4-(4-dimethylaminocinnamoyl)-1-acetylbenzene, acetoactic acid anilide, indanedione-(1,3), acenaphthenequinone dichloride, anisil, 2,2-pyridil and furil.

Further, in the other Lewis acid are included mineral acids such as for example hydrogen halogenide, sulfuric acid and phosphoric acid; organic carboxylic acids such as, for example acetic acid and its substituted derivative, monochloroacetic acid, dichloroacetic acid, trichloroacetic acid, aurin tricarboxylic acid, phenylacetic acid, 6-methylcumarinylacetic acid (4), maleic acid, cinnamic acid, benzoic acid, 1-(4-dimethylaminobenzoyl)-benzene-2-carboxylic acid, phthalic acid, tetrachlorophthalic acid, $\alpha,\beta$-dibromo-$\beta$-formylacrylic acid (mucobromic acid), dibromomaleic acid, 2-bromobenzoic acid, tannic acid, 3-nitro-2-hydroxy-1-benzoic acid, 2-nitrophenoxyacetic acid, 2-nitrobenzoic acid, 3-nitrobenzoic acid, 4-nitrobenzoic acid, 3-nitro-4-ethoxybenzoic acid, 2-chloro-4-nitro-1-benzoic acid, 3-nitro-4-methoxybenzoic acid, 4-nitro-1-methylbenzoic acid, 2-chloro-5-nitro-1-benzoic acid, 3-chloro-6-nitro-1-benzoic acid, 4-chloro-3-nitro-1-benzoic acid, 5-chloro-3-nitro-2-hydroxybenzoic acid, 4-chloro-2-hydroxybenzoic acid, 2,4-dinitro-1-benzoic acid, 2-bromo-5-nitrobenzoic acid, 4-chlorophenylacetic acid, 2-chlorocinnamic acid, 2-cyanocinnamic acid, 2,4-dichlorobenzoic acid, 3,5-dinitrobenzoic acid, 3,5-dinitrosalicyclic acid, malonic acid, mucic acid, acetosalicyclic acid, butane-tetracarboxylic acid, citric acid, cyanoacetic acid, cyclohexanedicarboxylic acid, cyclohexane-carboxylic acid, 9,10-dichlorostearic acid, fumaric acid, itaconic acid, levulinic acid, malic acid, succinic acid, $\alpha$-bromostearic acid, citraconic acid, dibromosuccinic acid, pyrene-2,3,7,8-tetracarboxylic acid and tartaric acid; organic sulfonic acids such as, for example, 4-toluenesulfonic acid, benzenesulfonic acid, 2,4-dinitro-1-methylbenzene-6-sulfonic acid, 2,6-dinitro-1-hydroxybenzene-4-sulfonic acid, 2-nitro-1-hydroxybenzene-4-sulfonic acid, 4-nitro-1-hydroxy-2-benzenesulfonic acid, 3-nitro-2-methyl-1-hydroxybenzene-5-sulfonic acid, 6-nitro-4-methyl-1-hydroxybenzene-2-sulfonic acid, 4-chloro-1-hydroxybenzene-3-sulfonic acid; 2-chloro-3-nitro-1-methylbenzene-5-sulfonic acid and 2-chloro-1-methylbenzene-4-sulfonic acid.

The phenol resin which is used for the original plate for printing according to this invention can be employed by mixing it with styrene-maleic anhydride copolymer, shellac, epoxy resin, acrylic resin, polyvinyl acetate, acetylbutylcellulose, polyvinyl alcohol, gelatin, casein, a phenol resin which does not belong to the phenol resin according to this invention, or the like. Preferably, the repeating unit of the phenol resin according to this invention is contained in the mixture in an amount of not less than 50 mole % in case of the unit represented by formula [1], or not less than 20 mole % in case of the unit represented by formula [2], against the total monomer unit of the polymers contained in the mixture.

In the phenol resin for the printing plate according to this invention may be incorporated a plasticizer, which is effective for giving a desired flexibility to the recording layer coated on a support. As the effective plastizers may be mentioned, for example, esters of phthalic acid such as dimethyl phthalate, diethyl phthalate, dibutyl phthalate, diisobutyl phthalate, dioctyl phthalate, octylcapryl phthalate, dicyclohexyl phthalate, ditridecyl phthalate, butylbenzyl phthalate, diisodecyl phthalate and diallyl phthalate; glycol esters such as dimethyl glycol phthalate, ethylphthalyl ethyl glycolate, methylphthalyl ethyl glycolate, butylphthalyl butyl glycolate and triethylene glycol dicapryl ester; esters of phosphoric acid such as tricresyl phosphate and triphenyl phosphate; esters of dibasic fatty acids such as diisobutyl adipate, dioctyl adipate, dimethyl cebacate, dibutyl cebacate, dioctyl azelate and dibutyl maleate; polyglycidyl methacrylate; triethyl citrate; triacetyl ester of glycerol; butyl laurate; and the like.

These plasticizers may be incorporated in the phenol resin according to this invention in such an amount as not to lower the electrostatic property and the solubility in an alkaline solution of the recording layer.

For the support for printing material which effectively is used in this invention, there may preferably be mentioned a substrate which is a hydrophilic insulator, has a low electroconductivity or is electro-conductive, for example, an original paper for offset printing; an aluminium plate; a zinc plate; bimetal plates such as a copper-aluminium plate, a copper-stainless steel plate and a chromium-copper plate; trimetal plates such as chromium-copper-aluminium plate, chromium-copper-iron plate and chromium-copper-stainless steel plate; a support obtained by lamination or vaporization of a metal such as aluminium, palladium, copper, iron, nickel, stainless steel, gold, silver, tin and zinc, or of a metal oxide such as tin oxide; a support obtained by coating on a paper or a plastic film a composition dispersing a resin and the above-mentioned metal, metal oxide or a powder of Carbon Black; and so on. There may preferably be employed electro-conductive or low-conductive substrate which has a hydrophilic surface.

In case of a support having a surface of aluminium, it is preferable that the surface be treated by graving; by dipping in an aqueous solution such as sodium silicate, potassium fluorozirconate, a salt of phosphoric acid (phosphate) or the like; or by anode oxidation. There may preferably be used also an aluminium plate which was treated by dipping in an aqueous solution of sodium silicate after treated by graining, as is described in U.S. Pat. No. 2,714,066; and an aluminium plate which was treated by dipping in an aqueous solution after treated by anode oxidation, as is described in Japanese Patent Publication Specification No. 47-5125/1972. The anode oxidation treatment is carried out by sending an electric current through the aluminium plate as an anode in an aqueous or non-aqueous solution of an inorganic acid such as phosphoric acid, chromic acid, sulfuric acid or boric acid; or an organic acid such as oxalic acid or sulfamic acid; or a salt thereof, in single or in combination thereof. Further, silicate electrodeposition as described in U.S. Pat. No. 3,658,662 is also effective. The treatment by polyvinyl sulfonic acid as described in German Laid Open to Public Specification (Offenlegungsschrift) No. 1621478 is also suitable.

These treatments are conducted for the purpose of imparting hydrophilicity to the surface of a support as well as for the purpose of preventing harmful reaction of the surface with a recording layer coated thereon and of enhancing the adhesiveness of the surface with the recording layer.

Moreover, in the present invention an alkali-soluble intermediate layer comprising casein, polyvinyl alcohol, ethylcellulose, phenol resin, styrene-maleic anhydride copolymer, polyacrylic acid or the like may be located, if necessary, between said hydrophilic substrate and recording layer for the purpose of improving the adhesiveness of said support and recording layer or the electrostatic property of the recording layer.

In the present invention, an overcoat layer which is dissolved when the recording layer is removed may be located on the recording layer for the purpose of improving the electrostatic property of the recording layer, the development property at the time of toner development or the image pattern property as occasion demands. The overcoat layer may be matted mechanically or may be a resin layer containing a matting agent. The matting agent includes silicon dioxide, zinc oxide, titanium oxide, zirconium oxide, glass grain, alumina, starch, polymer particle (e.g., particle of polymethylmethacrylate, polystyrene, phenol resin or the like.) and the matting agents described in U.S. Pat. Nos. 2,701,245 and 2,992,101. The resin which is to be used for the resin layer containing a matting agent may be selected as occasion demands, depending upon the combination with the solution for removing the recording layer. There may concretely be mentioned, for example, gum arabic, glue, gelatin, casein, celluloses (e.g., viscose, methylcellulose, ethylcellulose, hydroxyethylcellulose, hydroxypropylcellulose, carboxymethylcellulose, etc.), starches (e.g., soluble starch powder, modified starch powder, etc.), polyvinyl alcohol, polyethylene oxide, polyacrylic acid, polyacrylamide, polyvinyl methyl ether, epoxy resin, phenol resin (particularly a nonolak type phenol resin is preferred), polyamide, polyvinyl butyral and so on. More than one of these resins may be used in combination.

In order to prepare the original plate for printing according to this invention, which comprises a recording layer having no photo-sensitivity or a layer to which an electrostatic latent image is transferred, the phenol resin according to this invention is dissolved in a suitable organic solvent as mentioned above; coated on the hydrophilic substrate mentioned above in a thickness of 1 to 50$\mu$, preferably 1 to 15$\mu$; and then dried. In such recording layer may be dispersed polymer particles or a pigment.

In order to prepare the electrophotographic material which may be used for an original plate for printing or for an electrophotographic photoreceptor per se, one part by weight of the above-mentioned photo-conductive material is admixed with 0.01 to 100 parts preferably 3 to 20 parts, by weight (preferably a range where the photoconductive insulating layer can be dissolved and removed) of the above-mentioned phenol resin; dissolved in a suitable organic solvent such as ethylene glycol monoethyl ether, methyl ethyl ketone, acetone, a halogenated hydrocarbon, toluene, tetrahydrofuran, ethyl acetate, etc., or dispersed therein substantially homogeneously by using a homogenizer, an ultrasonic dispersing machine or the like in cases wherein the photoconductive material is insoluble; coated on the hydrophilic substrate as mentioned above in a thickness of 1 to 50$\mu$., preferably 1 to 15$\mu$.; and then dried.

An original plate for printing in which is located on a hydrophilic substrate a recording layer having a phthalocyanine pigment dispersed in the phenol resin according to this invention is suitable in particular for the purpose of this invention.

Namely, such an original plate is prepared by coating a layer for obtaining electrostatic latent image in which a photoconductive phthalocyanine pigment, e.g., a phthalocyanine pigment of $\alpha$, $\beta$, $\gamma$, $\pi$, $\epsilon$ or X type, in a phenol resin having a repeating unit represented by the general formula mentioned above in an amount of one part by weight of the pigment against 1 to 50 parts by weight of the resin, on a substrate such as a graved hydrophilic aluminium, or zinc- or copper-aluminium plate in a dry thickness of 1 to 15$\mu$.

This original plate for printing is high-sensitive in spite of the rich of the resin content as compared with the pigment content; the grain is extremely fine; and an extremely sharp toner image can be obtained.

Because of the rich of the resin content as compared with the pigment content, the recording layer is resistant against an electric shock such as corona discharge or discharge by needle electrode and thus is not damaged. Moreover it shows such an effect as that it can be charged positively or negatively.

Coating method can be effected by various methods such as dip coating, air-knife coating, bead coating, curtain coating and an extrusion coating using a hopper as shown in U.S. Pat. No. 2,681,294.

The development method used in this invention includes a dry process using a developer containing a toner and a carrier both of which are solid; a wet process using a developer containing a toner and a carrier one of which is liquid; and an aerosol process using an air as a carrier regardless of a toner being solid or liquid. In order to obtain a highly resolved image, liquid development process is preferred.

The toner which is used in this invention may preferably be hydrophobic and receptive for an ink, and comprises a macromolecular substance such as a polystyrene group resin, a polyester group resin, an acrylate group resin (amino-group-containing acrylate, long-chain acrylate, etc.), a phenolic group resin (a resin having a phenolic hydroxyl group or a sulfone group), an epoxy resin, a plant oil, a modified alkyd resin, a cyclized rubber, asphalt, polyvinyl chloride or the like. The toner may be incorporated with a coloring agent such as, for example, carbon black, Nigrocine pigment, Carmin 6B, Phthalocyanine Blue, Benzidine Yellow, Phthlocyanine Green or the like; and further an electron charge controlling agent such as for example a metal salt of a fatty acid or a naphthenic acid, a metal-containing dye, a sulfonic acid salt or the like.

The original plate for electrophotographic printing according to this invention can give a toner image, after charging according to an ordinary electrophotographic process, by reflectional exposure using as a light source a xenone lamp, a halogen lamp, a tungsten lamp, a fluorecent lamp or the like; by exposure using a semiconductor laser, or a laser of $Ar^+$, He—Ne or the like; or by contact exposure through a transparent positive film. A toner image may also be obtained by charging after exposure and utilizing a photoconductive memory.

After a toner image is obtained according to such method as mentioned above, it is fixed under heating by a hot plate, a hot roller, a hot line, etc., and the plate having the fixed toner image is dipped in an aqueous alkaline solution such as aqueous sodium silicate and sodium phosphate, an organic solvent such as benzyl alcohol and ethylene glycol monobutyl ether, or solvent containing a surfactant, etc., to dissolve and remove the non-image part (part having no toner adhered). Thus, only the part having the toner adhered is left on the surface of the support and a good printing plate can be obtained. In the fixing process, the burning of the recording layer may be conducted if necessary.

After formation of a toner image in the printing plate according to this invention, a quinone diazide compound (e.g., o-naphthoquinone diazide) or a diazo compound may be incorporated in order to increase the solubility of the recording layer after over-all exposure.

Further, the original plate for printing according to this invention can give two kinds of printing plates, i.e., positive-positive and negative-positive plates, with one kine of developer, by utilizing the property of being charged either positively or negatively. This method utilizes the reversal development of a liquid development process and is an extremely useful plate-making method in industry.

The original plate according to this invention presents, by corrosion after formation of a toner image, a printing plate (lithograph or relief) having high resolving power and high resistance (abrasion resistance: around one hundred thousand sheets) with exposure by small amount of light (dozens of erg/cm$^2$). Further, it has industrial advantages in that it can form a contact film for printing plate, a micro-film, etc., by using a transparent support, and that it can give a print circuit by using a electro-conductive supporting substrate.

Next, the present invention will be explained more fully by way of Examples, which should not be construed to limit the embodiment of the present invention.

EXAMPLE 1

| | |
|---|---|
| ε-Type copper phthalocyanine pigment which had been manufactured by Toyo Ink Manufacturing Co., Ltd. | 1 part by weight |
| Exemplified compound 2 | 6 parts by weight |
| Ethylene glycol monoethyl ether | 24 parts by weight |

The composition having the above-mentioned weight ratio of the components was well mixed for 5 minutes with an ultrasonic dispersor at room temperature and then coated by using a rotary coater and rotating said coater at a rate of 500 r.p.m. on an aluminium plate of around 100μ. in thickness treated by anode oxidation so that the weight of the coating may be around 0.4 mg./cm$^2$ after drying. The thus obtained original plate for electrophotographic printing was heated and dried for around 3 hours in a drier of 60° C. to make a specimen.

Electrostatic properties of the thus prepared original plate for electrophotographic printing were measured by using an Electrostatic Paper Analyzer SP-428 manufactured by Kawaguchi Electric Co., Ltd. The measurement was conducted by exposing the surface of the specimen at an illuminance of 35 luxes to a tungsten lamp of 2854° K. after positive charging by corona discharge of +6.0 KV for 10 seconds in a dark room. As the result, it was found that saturated charge potential was 500 V and half-decay exposure was 20 lux.-second.

Next, the specimen was subjected to corona discharge of +6.0 KV in a dark room so that the surface potential may be +200 V and then exposed to a tungsten lamp with a positive image (80 lux.second). Then, liquid development was carried out in a bat made of stainless steel by using MRP toner manufactured by Richo Co., Ltd., which comprises as a carrier liquid an isoparaffin group solvent named Isopar H (manufactured by Esso Standard Co., Ltd.), so that a positive-positive toner image which was very clear could be obtained on the specimen of the original plate for electrophotographic printing.

This original plate for electrophotographic printing was dipped in an alkaline aqueous solution comprising sodium silicate and caustic soda to remove a non-image part (a part adhering no toner) of the photoconductive layer. As the result, a lithograph being excellent in resolving power and abrasion resistance and having a clear image could be prepared.

On the other hand, a comparative specimen was prepared in the same manner as in the above-mentioned specimen except that a p-butylphenol-formaldehyde resin (Exemplified comparative compound 1 mentioned below) was used in place of the phenol resin mentioned above. A toner image which was obtained according to the above-mentioned process for forming a toner image was unclear because the toner ran to blur. Moreover, the photoconductive layer could not be removed with an alkaline aqueous solution having the same composition as in Example 1.

It may be considered that, in the comparative specimen, a toner image becomes unclear because an binder, that is, the t-butylphenol-formaldehyde resin is dissolved, swelled or softened in the carrier liquid of the liquid developer.

EXAMPLE 2

Three kinds of original plates for electrophotographic printing were prepared according to the process of Example 1 by using various phenol resins shown in the above mentioned list of Exemplified compounds.

On the other hand, Comparative specimens were prepared according to the process of Example 1 by using comparative resins mentioned below to conduct comparative tests.

Properties of the toner images and solubilities in said alkaline aqueous solution of the resins in the specimen of this invention and the comparative specimens of original plate for electrophotographic printing were shown in Table 1.

Exemplified comparative compound:

(1)

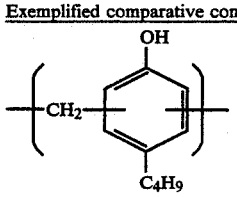

M ≈ 1,500

(2)

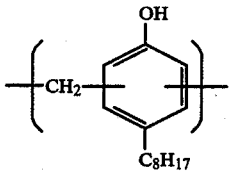

M ≈ 2,000

(3)

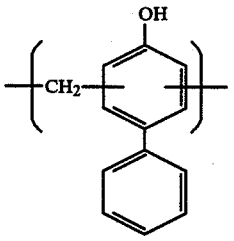

M ≈ 2,000

(4)

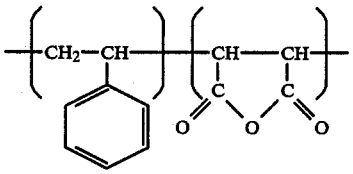

wherein M represents an average molecular weight.

TABLE 1

| No. | Resin | Toner image | Solubility in alkaline solution |
|---|---|---|---|
| 1 | Exemplified compound 1 | clear | good |
| 2 | Exemplified compound 3 | clear | good |
| 3 | Exemplified compound 71 | clear | good |
| 4 | Exemplified comparative compound 2 | unclear | poor |
| 5 | Exemplified comparative compound 3 | unclear | poor |

From the results of Table 1, it can be understood that the original plate for electrophotographic printing according to this invention is easily soluble in an alkaline aqueous solution, gives more clear toner image and is extremely excellent as compared with the comparative specimens. It may be considered that it is becuase the nonolak type phenol resin used in the original plate for electrophotographic printing according to this invention is not dissolved, swelled or softened in the carrier liquid of the liquid developer.

EXAMPLE 3

Reversal development was conducted in the same manner as in Example 1 except that a corona discharge of −6.0 KV was applied in a dark room; a negative image was exposed; and a net-like opposing electrodes made of stainless steel was used, so that a clear negative-positive toner image could be obtained on the specimen of the original plate for electrophotographic printing in which was used Exemplified compound 2 mentioned above.

Upon removal of the area having no toner of the photoconductive layer on the original plate for electrophotographic printing according to the same process as in Example 1 by using an alkaline aqueous solution, a lithograph which was excellent in resolving power and abrasion resistance and gave a clear image could be prepared.

EXAMPLE 4

The spectral sensitivity of the specimen of an original plate for electrophotographic printing described in Example 1 was measured to give a result as shown in FIG. 1. Spectral sensitivity was evaluated by the inverse number of exposure required for half-decay of the surface potential. From this result, it will be understood that a He—Ne laser or a semi-conductor laser is suitable for this original plate for printing.

Comparative example 1

A comparative specimen was prepared in the same manner as in Example 1 except that a styrene-maleic anhydride copolymer (Exemplified comparative compound 4, available from Monsants Co., Ltd.) was used as a resin and methyl ethyl ketone was used as a solvent. After electrostatic properties of the specimen were investigated in the same manner as in Example 1, it was found that, in case of positive charging, saturated charge potential was 150 V and exposure required for half-decay exposure was around 200 lux.second. In case of negative charging, saturated charging potential was 100 V and sensitivity was hardly shown when a corona discharge of −6.0 KV was applied.

From the results, it may be understood that the printing plate of this invention is extremely superior in charge-receiving property and sensitivity to that in which a styrene-maleic anhydride copolymer is used as a binder resin.

EXAMPLE 5

| | |
|---|---|
| Zinc oxide (manufactured by Sakai Kagaku Co., Ltd.) | 1 part by weight |
| Exemplified compound 1 | 1 part by weight |
| Methyl ethyl ketone | 1 part by weight |
| Rose Bengale | 0.01 part by weight |

A specimen was prepared in the same manner as in Example 1 except that the composition having the above-mentioned weight ratio of the components was used to give a coating having a thickness of 5μ., and electrostatic properties thereof were investigated in the same manner as in Example 1. As the results, it was revealed that, in case of negative charging, saturated charge potential was −270 V and half-decay exposure was 72 lux.second.

In cases where the plate was charged positively, saturated charge potential was +200 V and half-decay exposure was 140 lux.second.

From the above going, it may be understood that the original plate for electrophotographic printing according to this invention can be charged either positively or negatively and is suitable for plate-making for both negative-positive and positive-positive uses.

On the other hand, a comparative specimen was prepared in the same manner as in the above specimen except that Exemplified comparative compound 1 was used as a resin, and the thus prepared specimen was subjected to liquid development to obtain a toner image. As the results, it was found that the recording layer in the comparative specimen was damaged by the liquid developer and apt to be separated from the coating substrate and thus a printing plate having abrasion resistance and giving a distinct printing image could not be formed.

EXAMPLE 6

| | |
|---|---|
| α-Type copper phthalocyanine | 1 part by weight |
| 2,4,7-Trinitro-9-fluorenone | 3 parts by weight |
| Exemplified compound 2 | 20 parts by weight |
| Methyl ethyl ketone | 40 parts by weight |

A specimen was prepared in the same manner as in Example 1 except that a composition having the above-mentioned weight ratio of the components was used to give a coating having a thickness of 5μ., and electrostatic properties thereof were investigated.

As the result, saturated charge potential was −450 V and half-decay exposure was 18 lux.second in cases where the plate was charged negatively. In cases where the plate was charged positively, saturated charge potential was +460 V and half-decay exposure was °lux.-second.

From the above going, it may be understood that the original plate for electrophotographic printing according to this invention is suitable for plate-making for both negative-positive and positive-positive uses.

EXAMPLE 7

An original plate for electrophotographic printing in which was dispersed an ε-type copper phthalocyanine pigment was prepared in the same manner as in Example 1 by using as a binder resin a mixture of Exemplified compound 2 and Exemplified comparative compound 2 mentioned above, and a toner image and alkali-solubility thereof were investigated. As the result, it was found, as shown in Table 2, that the clearness of a toner image was dependent upon the resin of Exemplified compound 2. There was recognized an effect which was obtained by the addition of the resin used in the original plate for printing according to this invention to a resin which is dissolved, swelled or softened in a liquid developer.

TABLE 2

| | | | | | |
|---|---|---|---|---|---|
| Exemplified compound 2 | 100 mol. % | 75 mol. % | 50 mol. % | 25 mol. % | 0 mol. % |
| Exemplified comparative compound 2 | 0 mol. % | 25 mol. % | 50 mol. % | 75 mol. % | 100 mol. % |
| Toner image | clear | clear | slightly clear | unclear | unclear |
| Solubility in alkaline solution | good | slightly good | slightly good | slightly good | poor |

EXAMPLE 8

| | |
|---|---|
| α-Type copper phthalocyanine pigment, Fastgen Blue FSN (manufactured by Dainippon Ink Chemicals Inc.) | 1 part by weight |
| Phenol-formaldehyde resin having methyl groups at the para- and meta-positions (Exemplified compound 1) | 5 parts by weight |
| Methyl ethyl ketone | 40 parts by weight |

A composition having the above-mentioned weight ratio of the components was mixed at room temperature for 5 minutes by using an ultrasonic dispersor, and the thus prepared mixture was coated on an electroconductive support, which had been obtained by laminating an alminium having a thickness of 10μ. on a polyester film having a thickness of 80μ., by rotating a rotary, coater at 300 r.p.m., so that the dry thickness might be 7μ. The thus obtained photoreceptor was dried for around one hour in a drier heated at 80° C. to prepare a specimen of a photoreceptor.

Electrostatic properties of the thus prepared photoreceptor were measured by an Electrostatic Paper Analyzer SP-428 manufactured by Kawaguchi Electric Co., Ltd. The measurement at this time was conducted by exposing the surface of the specimen to a tungsten light of 2854° K. at an illuminance of 35 luxes after applying a corona discharge of +6.0 KV to the photoreceptor for 10 seconds in a dark room to charge the same positively.

As the result, it was found that the attenuation of surface potential by light was depicted as an L-shaped curve, as shown in FIG. 2, by which the light-sensitive layer was supposed not to have a trap of a carrier (in this case, a hole); that the attenuation was fast at the earlier stage of the light radiation; and that the photoreceptor showed good electrostatic properties, being excellent in repetition properties and being good in gradation.

On the other hand, a specimen of a comparative photoreceptor was prepared in the same manner as in the specimen mentioned above except that a phenolformaldehyde resin having t-butyl groups at the paraposition (Exemplified comparative compound 5 mentioned below) was used in place of the binder resin (Exemplified compound 1) in the above-mentioned composition, and the electrostatic properties thereof were investigated according to the measuring method mentioned above. As the results, the attenuation of surface potential by light was depicted as an S-shaped curve, as shown in FIG. 3, by which the light-sensitive layer was supposed to have a trap of a carrier (in this case, a hole), and it may accordingly be understood that the deterioration of the comparative specimen became larger during the repetition.

EXAMPLE 9

Sixteen kinds of specimens of photoreceptor were prepared according to the procedure of Example 8 by using various phenol resins shown as Exemplified compounds mentioned above and various phthalocyanine group pigments mentioned above.

On the other hand, six kinds of comparative specimens of photoreceptor, in which were used the comparative resins mentioned below, were prepared according to the method of Example 8. Twenty-one kinds of comparative tests were conducted by combining these. Electrostatic properties of these specimens and comparative specimens of photoreceptor were measured in the same manner as in Example 8. The results are shown in Table 3.

Exemplified comparative compound:

(5)

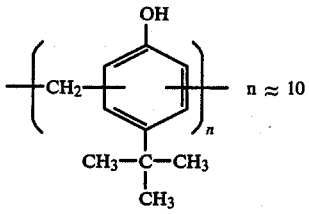

(6)

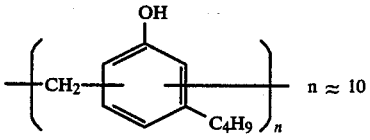

(7)

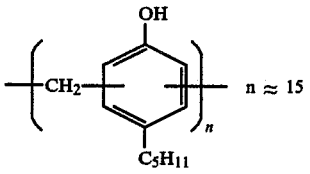

(8)

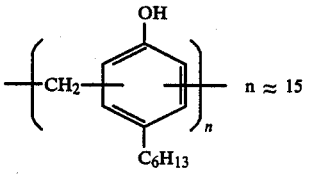

(9)

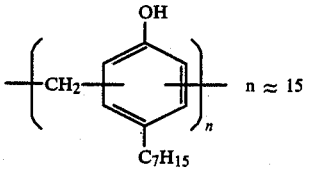

-continued

Exemplified comparative compound:

(10)

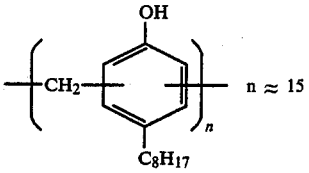

(11)

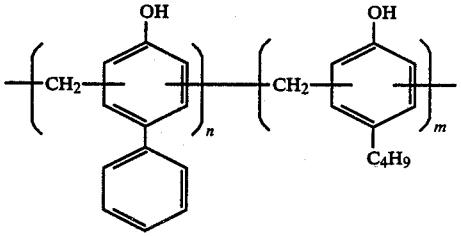

n ≈ 10 m ≈ 15

(12)

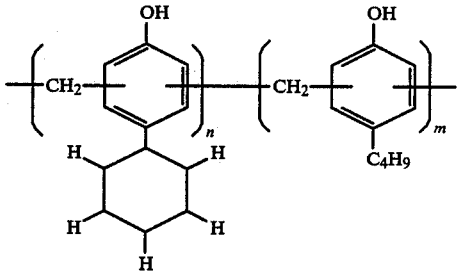

n ≈ 10 m ≈ 18

(13)

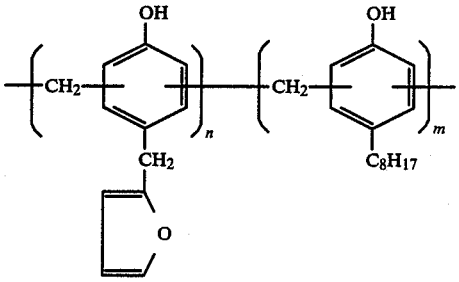

n ≈ 15 m ≈ 18

TABLE 3

| No. | Resin | Phthalocyanine group pigment | Polarity of charge | Attenuation by light | Repetitionary properties |
|---|---|---|---|---|---|
| 1 | Exemplified compound 1 | ε-type copper phthalocyanine | (+) | L-shaped | good |
| | Exemplified comparative compound 5 | ε-type copper phthalocyanine | " | S-shaped | relatively bad |
| 2 | Exemplified compound 1 | β-type copper phthalocyanine | " | L-shaped | good |
| | Exemplified comparative compound 5 | β-type copper phthalocyanine | " | S-shaped | bad |
| 3 | Exemplified compound 2 | ε-type copper phthalocyanine | " | L-shaped | good |

TABLE 3-continued

| No. | Resin | Phthalocyanine group pigment | Polarity of charge | Attenuation by light | Repetitionary properties |
|---|---|---|---|---|---|
| | Exemplified comparative compound 5 | ε-type copper phthalocyanine | " | S-shaped | relatively bad |
| 4 | Exemplified compound 3 | ε-type copper phthalocyanine | " | L-shaped | good |
| | Exemplified comparative compound 6 | ε-type copper phthalocyanine | " | S-shaped | bad |
| 5 | Exemplified compound 5 | ε-type copper phthalocyanine | " | L-shaped | very good |
| | Exemplified comparative compound 6 | ε-type copper phthalocyanine | " | S-shaped | bad |
| 6 | Exemplified compound 7 | α-type copper phthalocyanine | " | L-shaped | good |
| | Exemplified comparative compound 7 | α-type copper phthalocyanine | " | S-shaped | bad |
| 7 | Exemplified compound 9 | α-type copper phthalocyanine | " | L-shaped | good |
| | Exemplified comparative compound 8 | α-type copper phthalocyanine | " | S-shaped | bad |
| 8 | Exemplified compound 11 | α-type copper phthalocyanine | " | L-shaped | good |
| | Exemplified comparative compound 9 | α-type copper phthalocyanine | " | S-shaped | bad |
| 9 | Exemplified compound 13 | α-type copper phthalocyanine | " | L-shaped | good |
| | Exemplified comparative compound 10 | α-type copper phthalocyanine | " | S-shaped | bad |
| 10 | Exemplified compound 15 | α-type copper phthalocyanine | " | L-shaped | good |
| | Exemplified comparative compound 10 | α-type copper phthalocyanine | " | S-shaped | bad |
| 11 | Exemplified compound 17 | α-type copper phthalocyanine | " | L-shaped | good |
| | Exemplified comparative compound 10 | α-type copper phthalocyanine | " | S-shaped | bad |
| 12 | Exemplified compound 19 | α-type copper phthalocyanine | " | L-shaped | nearly good |
| | Exemplified comparative compound 10 | α-type copper phthalocyanine | " | S-shaped | bad |
| 13 | Exemplified compound 21 | α-type copper phthalocyanine | " | L-shaped | good |
| | Exemplified comparative compound 11 | α-type copper phthalocyanine | " | S-shaped | bad |
| 14 | Exemplified compound 23 | α-type copper phthalocyanine | " | L-shaped | nearly good |
| | Exemplified comparative compound 12 | α-type copper phthalocyanine | " | S-shaped | bad |
| 15 | Exemplified compound 25 | α-type copper phthalocyanine | " | L-shaped | good |
| | Exemplified comparative compound 13 | α-type copper phthalocyanine | " | S-shaped | bad |
| 16 | Exemplified compound 26 | ε-type copper phthalocyanine | " | L-shaped | good |
| | Exemplified comparative compound 5 | ε-type copper phthalocyanine | " | S-shaped | relatively bad |
| 17 | Exemplified compound 16 | ε-type copper phthalocyanine | " | L-shaped | good |
| | Exemplified comparative compound 5 | ε-type copper phthalocyanine | " | S-shaped | relatively bad |
| 18 | Exemplified compound 30 | ε-type copper phthalocyanine | " | L-shaped | nearly good |
| | Exemplified comparative compound 5 | ε-type copper phthalocyanine | " | S-shaped | relatively bad |

The repetition properties were evaluated by repeating the charging and exposure according to the method as mentioned in Example 8 and by classifying the variations of the attenuations at the first and fifth repetition processes in the following 5 ranks.

Very good: no variation
Good: almost no variation
Nearly good: slight variation
Relatively bad: variation
Bad: remarkable variation As the phthalocyanine pigments described in Table 3, there were used the commercially available products as follows.

| | |
|---|---|
| α-Type phthalocyanine | Fastgen Blue FNS (manufactured by Dainippon Ink Chemicals Inc.) |
| β-Type phthalocyanine | Fastgen Blue FGF (manufactured by Dainippon Ink Chemicals Inc.) |
| ε-Type phthalocyanine | One which had been prepared according to the method described in Japanese Laid-open-to-public Publications |

-continued

Nos. 76925/1973 and 59136/1974.

From the results of Table 3, it may be understood that the repetition properties of the photoreceptor according to this invention is remarkably superior to those of the comparative photoreceptors.

While the comparative photoreceptor, in case when it was charged positively, shows an attenuation-by-light curve depicted as an S-shaped one, the photoreceptor according to this invention shows an L-shaped attenuation curve.

As for the reasons why the photoreceptor of this invention showing an L-shaped attenuation curve shows little deterioration in repetition processes, it may be supposed that a photoreceptor showing an S-shaped attenuation curve generally contains large amounts of traps of a carrier (in this case, a hole) and thus deteriorates in the repetition process due to the deformation of the curve, while a photoreceptor showing an L-shaped attenuation curve contains small amounts of traps of a carrier and thus deteriorates little.

EXAMPLE 10

A photoreceptor in which an ϵ-type phthalocyanine pigment was dispersed in a binder resin obtained by mixing the above-mentioned Exemplified compound 1 with an epoxy resin (Epikote 1001, manufactured by Shell Chemical Co., Ltd.) was prepared and the attenuation by light of the surface potential of the thus prepared photoreceptor was investigated in the same manner as in Example 8.

As the results, it is recognized, as shown in Table 4, that the L-shaped attenuation property depends upon the resin of Exemplified compound 1 according to this invention and there is little variation in the attenuation period, and the effect by the addition of the resin according to this invention which has a substituent of not more than 3 carbon atoms in the repeating unit mentioned above may be recognized.

TABLE 4

| | | | | | |
|---|---|---|---|---|---|
| Exemplified compound 1 | 100 mol. % | 75 mol. % | 50 mol. % | 25 mol. % | 0 mol. % |
| Epoxy resin | 0 mol. % | 25 mol. % | 50 mol. % | 75 mol. % | 100 mol. % |
| Attenuation by light | L-shape | L-shape | L-shape | L-shape | S-shape |
| Repetition property | good | good | good | nearly good | bad |
| Half-decay exposure (1st process, lux · sec.) | 18 | 20 | 22 | 26 | 30 |
| Half-decay exposure (5th process, lux · sec.) | 18 | 20 | 22 | 25 | 24 |
| Variance (%) | 0 | 0 | 0 | 4 | 25 |

Variance=[(Exposure required for half-decay of surface potential at the 1st process)—(Exposure required for half-decay of surface potential at the 5th process)]×100/(Exposure required for half-decay of surface potential at the 5the process)

EXAMPLE 11

By using Exemplified compound 1 as a binder and changing the mixing ratio of the resin and an ϵ-type copper phthalocyanine pigment, photoreceptors were prepared. The exposures required for half-decay of the surface potential were shown in FIG. 4.

From FIG. 4, it will be understood that the photosensitivity shows nearly constant value in the range of 1:3–20 in the mixing ratio of the ϵ-type copper phthalocyanine and the resin. When the amount of the resin becomes larger than this range, the photosensitivity rapidly decreases. Although the photosensitivity rapidly increases when the amount of the resin becomes smaller than the range, the attenuation in dark increases, according to another experiment, due to too insufficient amount of the resin and the photoreceptor thus obtained can not be used. Therefore, it will be understood that the mixing ratio of the ϵ-type phthalocyanine and the resin may preferably range from 1:3 to 1:20.

Figure 1:
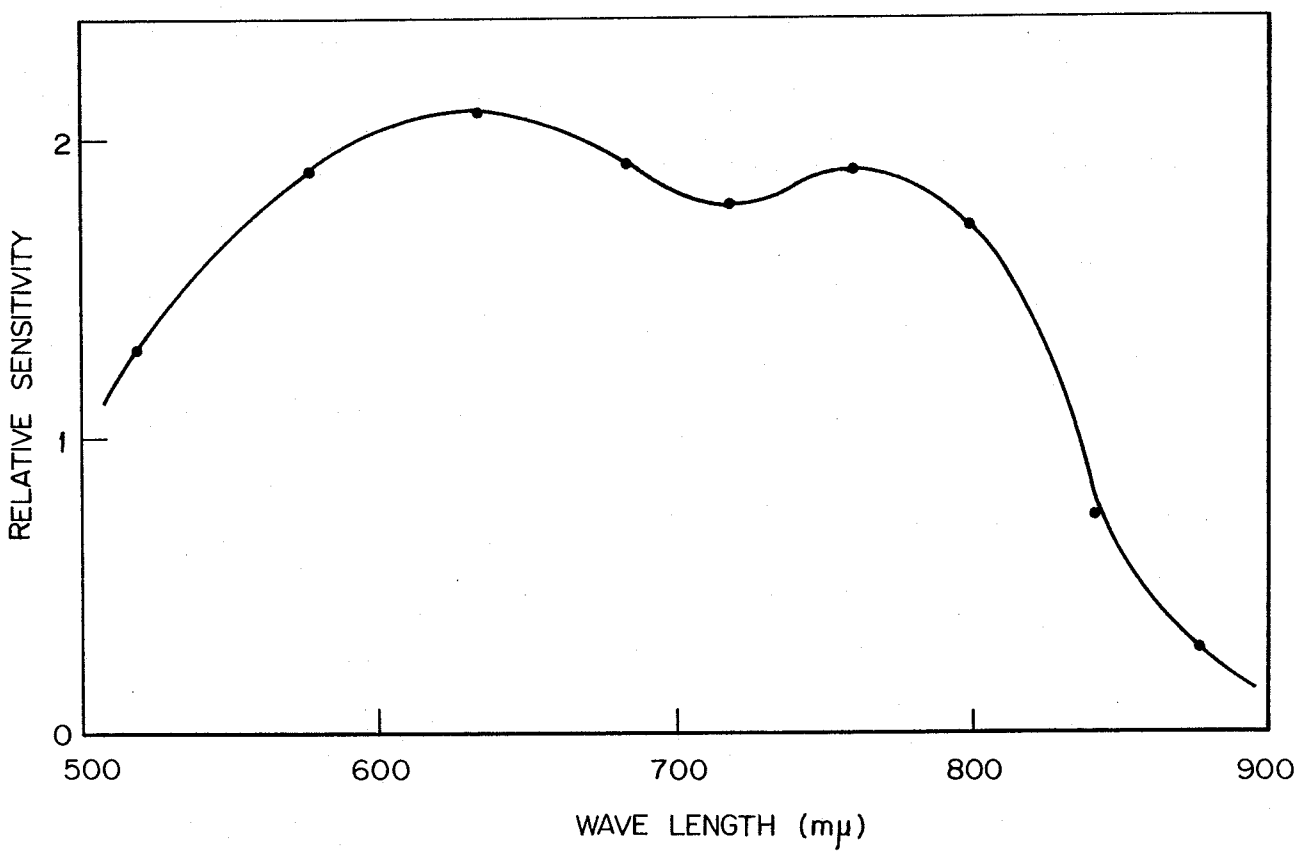
FIG. 1 is a spectrosensitivity-curve of phthalocyaninebinder recording layer of Example 1.
Figure 2:
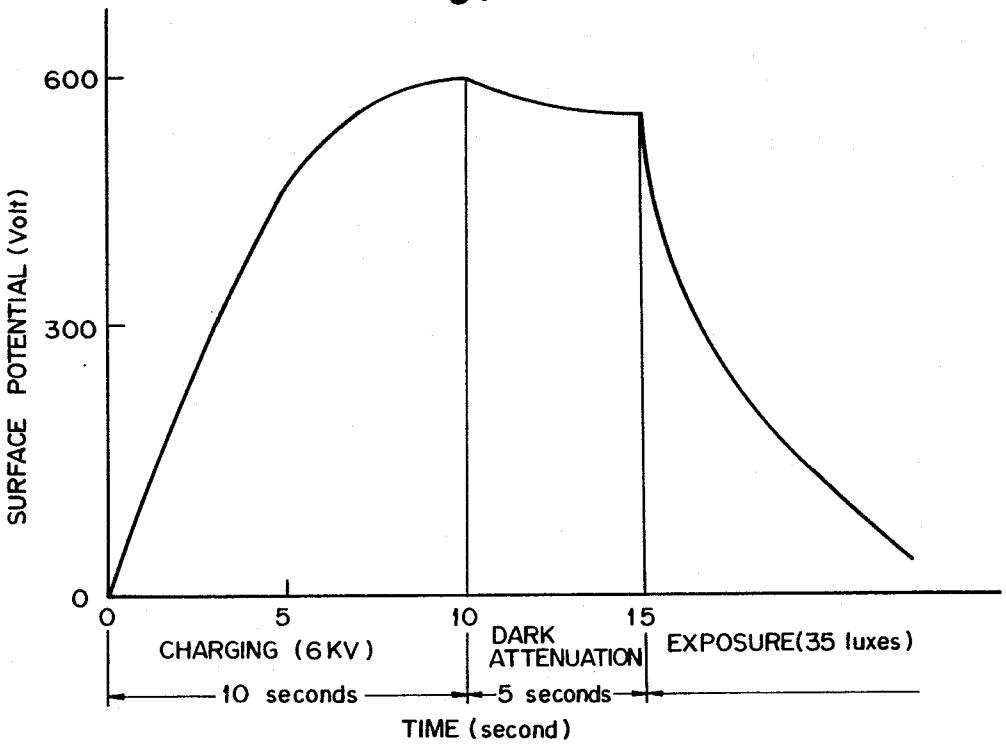
FIG. 2 is a diagram for electrostatic characteristic of photoreceptor specimen of Example 8.
Figure 3:
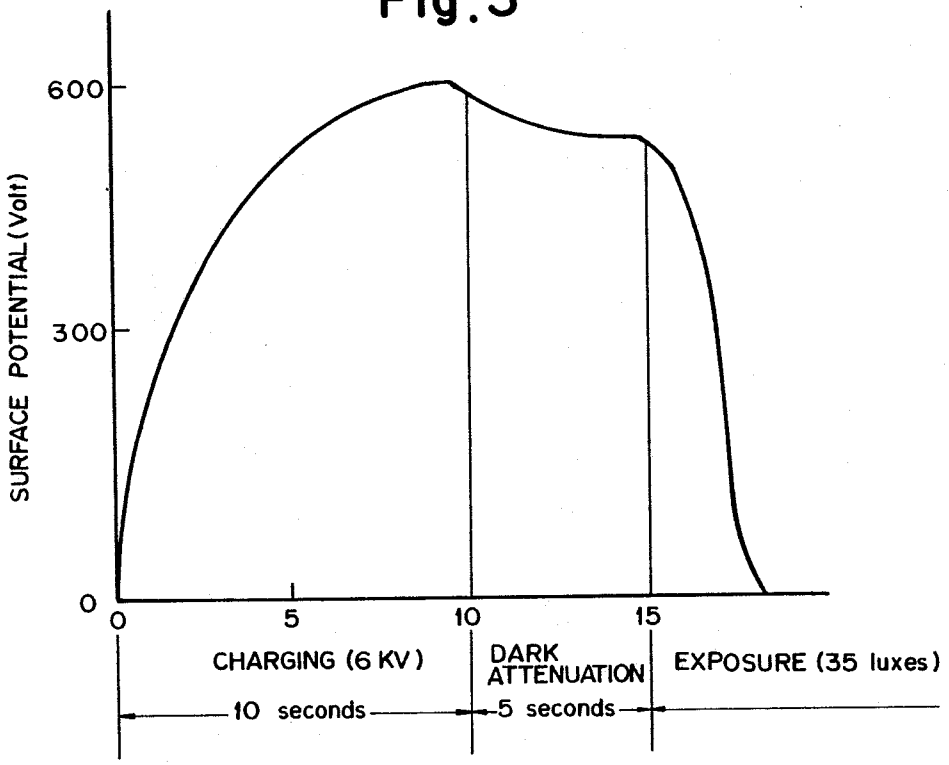
FIG. 3 is a diagram for electrostatic characteristic of comparative photoreceptor specimen of Example 8.
Figure 4:
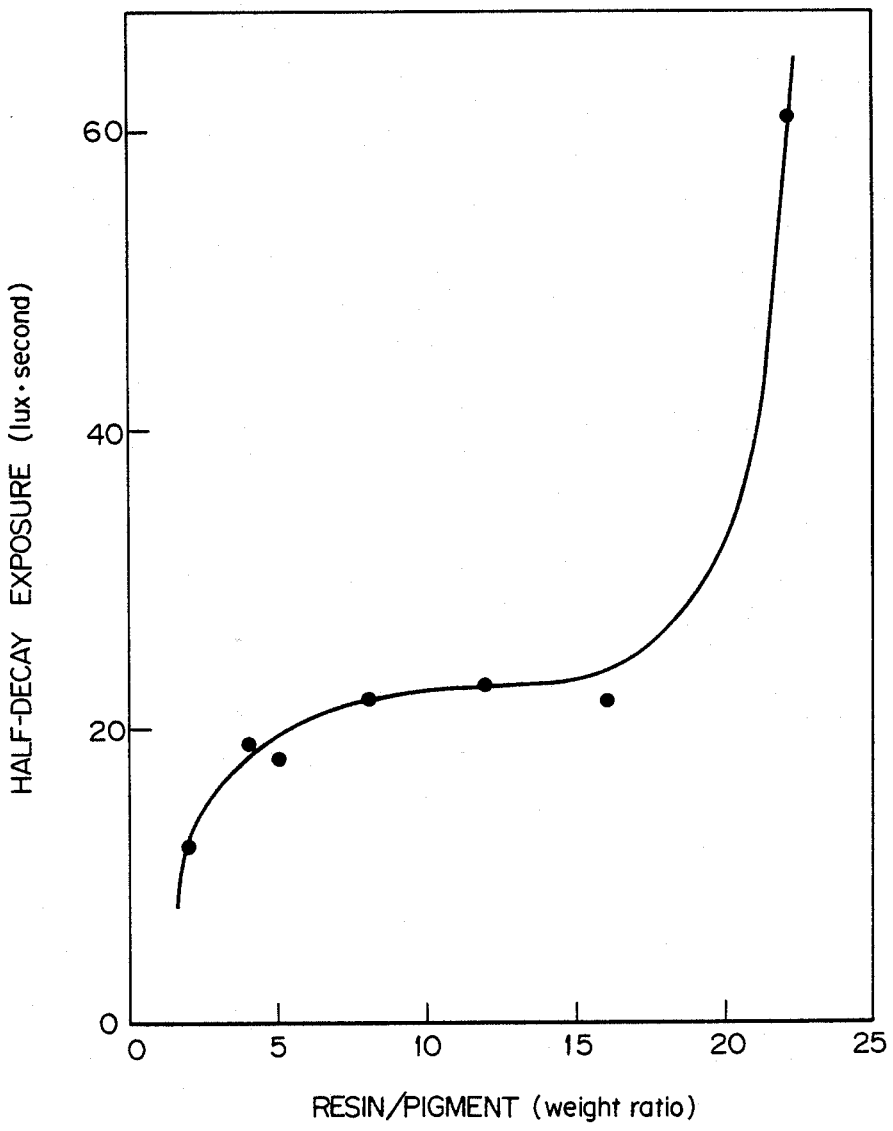
FIG. 4 is a diagram in which is disclosed that amount of ϵ-type copper phthalocyanine pigment relate to half-decay exposure for Example 11.

What is claimed is:

1. A process for forming a printing plate, comprising the steps of forming a toner image by liquid development on an original plate for printing which had been exposed imagewise to light, said plate having a support and a photosensitive layer for obtaining an electrostatic latent image coated thereon, and then dissolving the no toner image area of the layer with an alkaline solution to remove the same, wherein said layer comprises as a main component a phenol resin having a photoconductive phthalocyanine pigment dispersed therein, said phenol resin having a repeating unit represented by the formula (1):

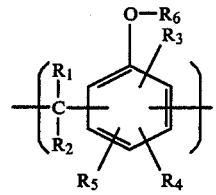

(1)

wherein $R_1$ and $R_2$ each represent hydrogen, a lower-alkyl group, an aryl group or a furfuryl group, provided that when one of $R_1$ and $R_2$ represents an aryl group or a furfuryl group, the other represent hydrogen; $R_3$, $R_4$ and $R_5$ each represent hydrogen, or an unsubstituted or substituted, saturated or unsaturated hydrocarbon group having 1 to 3 carbon atoms; $R_6$ represents hydrogen or a glycidyl group.

2. The process of claim 1 wherein said liquid development is carried out by using one kind of liquid developers to form either negative-positive or positive-positive printing plate.

3. The process of claim 1 wherein said repeating unit is contained in an amount of not less than 50 mol.% against the total monomer units in the resin system.

4. The process of claim 1 wherein $R_1$ and $R_2$ each represent hydrogen or methyl; $R_3$, $R_4$ and $R_5$ each represent hydrogen or a substituted or unsubstituted hydrocarbon group having 1 to 3 carbon atoms selected from the group consisting of alkyl, allyl, alkoxyalkyl, and alkylcarbonylalkyl.

5. The process of claim 1 wherein $R_1$ and $R_2$ each represent hydrogen or methyl; $R_3$, $R_4$ and $R_5$ each represent hydrogen, or a substituted or unsubstituted hydrocarbon group having 1 to 3 carbon atoms; and wherein said repeating unit is contained in an amount of not less than 20 mole % based on the total monomer units in the resin system.

6. The process of claim 1 wherein said hydrocarbon group has a substituent halogen, a hydroxy group, a nitro group, a cyano group, an amino group, a carboxy group or salt thereof, or a sulfo group or a salt thereof.

7. The process of claim 1 wherein said phenol resin and said pigment are in a ratio of 1:3–20 by weight.

8. The process of claim 7 wherein said phthalocyanine pigment is selected from the group consisting of metal-free phthalocyanine, copper phthalocyanine, cobalt phthalocyanine, lead phthalocyanine, zinc phthalocyanine and magnesiunm phthalocyanine.

9. The process of claim 8 wherein said metal-free phthalocyanine and copper phthalocyanine are of an $\alpha$, $\beta$, $\gamma$, X, $\pi$ or $\epsilon$-type.

10. The process of claim 9 wherein said support is hydrophilic.

11. The process of claim 10 wherein said support is selected from the group consisting of an aluminum plate, a zinc plate, a copper-aluminum plate, a copper-stainless steel plate, a chromium-copper plate, a chromium-copper-aluminium plate, a chromium-copper-iron plate, a chromium-copper-stainless steel plate, a support obtained by lamination or vaporization of a metal or a metal oxide, and a support obtained by coating on a paper or a plastic film a composition dispersing a resin, metal, metal oxide or a powder of carbon black.

12. The process of claim 10 wherein the surface of said support is treated by graving, by dipping in aqueous solution of sodium silicate, potassium fluorozirconate, or a salt of phosphonic acid, or by anode oxidation.

13. The process of claim 1 wherein said phenol resin consists essentially of the said repeating unit wherein $R_1$ and $R_2$ are each hydrogen or a methyl group.

14. The process of claim 1 wherein said phenol resin has an average molecular weight of from 240 to 20,000.

15. The process of claim 1 wherein said phenol resin has an average molecular weight of from 350 to 6,000.

* * * * *